US011827256B1

(12) United States Patent
Sapp et al.

(10) Patent No.: US 11,827,256 B1
(45) Date of Patent: Nov. 28, 2023

(54) SYSTEM AND METHOD FOR VIRTUAL APPROACH SIGNAL RESTRICTION UPGRADE

(71) Applicant: BNSF Railway Company, Fort Worth, TX (US)

(72) Inventors: Scott D. Sapp, Smithville, MO (US); Mitchell W. Beard, Shawnee, KS (US); Michael E. Ramolt, Shawnee, KS (US)

(73) Assignee: BNSF Railway Company, Fort Worth, TX (US)

( * ) Notice: Subject to any disclaimer, the term of this patent is extended or adjusted under 35 U.S.C. 154(b) by 0 days.

(21) Appl. No.: 18/156,547

(22) Filed: Jan. 19, 2023

(51) Int. Cl.
*B61L 15/00* (2006.01)
*B61L 23/34* (2006.01)

(52) U.S. Cl.
CPC ..... *B61L 15/0072* (2013.01); *B61L 15/0018* (2013.01); *B61L 23/34* (2013.01)

(58) Field of Classification Search
CPC ..... B61L 15/072; B61L 15/0018; B61L 23/24
See application file for complete search history.

(56) References Cited

U.S. PATENT DOCUMENTS 6,655,639 B2 12/2003 Grappone
9,102,341 B2 8/2015 Malone, Jr. et al.
9,162,691 B2 10/2015 Polivka et al.
9,925,994 B2 3/2018 Ferrari et al.
10,081,379 B2 9/2018 Kull
11,021,178 B2 6/2021 Ghaly
2018/0319413 A1* 11/2018 Specht ..... B61L 21/10
2019/0168788 A1 6/2019 Ghaly
2020/0207384 A1* 7/2020 Dick ..... B61L 23/14
2021/0086805 A1 3/2021 Specht et al.
2021/0139059 A1 5/2021 Schmidt et al.
(Continued)

OTHER PUBLICATIONS

Dick et al., C.T. Relative Capacity and Performance of Fixed- and Moving-Block Control Systems on North American Freight Railway Lines and Shared Passenger Corridors, Google Scholar, Transportation Research Record, vol. 2673(5), 2019, pp. 250-261. (Year: 2019).*

(Continued)

*Primary Examiner* — Russell Frejd
(74) *Attorney, Agent, or Firm* — WHITAKER CHALK SWINDLE & SCHWARTZ PLLC; Enrique Sanchez, Jr.

(57) ABSTRACT

A system and method for providing a virtual approach signal restriction upgrade between physical signaling components is presented. In one embodiment, in a CTC type of operation, the use of a virtual signal with signal type functionality to split a block into two or more sections can allow a train currently governed by an approach indication to accelerate on a clear indication if the advance signal indication upgrades. The addition of audio frequency type circuits with the advance signal indication can allow a train to upgrade from a restricting indication to an approach or clear indication, while protecting open HT switches, broken rail, hazards, and follow up moves. The present invention provides a system for allowing trains to upgrade from a "restricting" indication to an "approach" or "clear and accelerate" indication with an upgraded PTC track line for the segment.

30 Claims, 11 Drawing Sheets

(56) References Cited

U.S. PATENT DOCUMENTS

| | | | | |
|---|---|---|---|---|
| 2021/0253147 | A1* | 8/2021 | Specht | B61L 11/08 |
| 2021/0253148 | A1* | 8/2021 | Specht | B61L 23/168 |

OTHER PUBLICATIONS

Zhao et al, Y. Positive Train Control with Dynamic Headway Based on an Active Communication System, Google Scholar, IEEE Transactions on Intelligent Transportation Systems, vol. 16, No. 6, Dec. 2015, pp. 3095-3103. (Year: 2015).*

Hann, G. Incremental Train Control System, Google Scholar, IEEE Vehicular Technology Magazine, vol. 5, Iss. 4, Dec. 2010, pp. 50-55. (Year: 2010).*

* cited by examiner

SYSTEM AND METHOD FOR VIRTUAL APPROACH SIGNAL RESTRICTION UPGRADE

TECHNICAL FIELD

The present disclosure relates generally to the generating virtual signals between physical signaling hardware, particularly systems and methods for operating a virtual approach signal.

BACKGROUND

Railway centralized traffic control (CTC) operations enable efficient use of railways, locomotives, and resources. The data acquired across the railway is useful in optimizing capacity of locomotives across a segment of track. The industry trend is positive train control (PTC). PTC enables efficient use of a railway through implementing a combination of physical and virtual blocks along the track. The segments of track can include corresponding signal locations, which are physical signaling components indicating a current status of the next segment of track to operators of the locomotive. The signal locations are physically separated from one another to maximize impact while maintaining efficient communication to the operators. However, the signal locations might be late to update the physical signaling components in response to railway events occurring in the next segment of track. For example, the CTC system will react to the railway event and transmit an updated PTC enforcement signal to the signal location, which might update the physical signaling components while the locomotive is already traveling along the next segment of track.

Railroad operations currently adhere to PTC speed enforcement rules for the operators to lock in the locomotive speed at each signal location. Thus, when the locomotive approaches the signal location, the speed identified by the signal location is the speed at which the locomotive must travel the entire length of the next segment of track. The delay in updating the physical signaling components can cause the operators issues by restricting the locomotive speed across the entire length of the next segment of track, even when the speed restriction is unnecessary. In an example, the restriction in speed can be represented as a restricting fence along the segment of track. For example, the PTC onboard terminal can display the segment of track without an ability to upgrade. The industry trend is for the locomotive operators typically to wait idle at an approach location until the physical signaling components indicate the next segment of track is all clear for the locomotive to proceed without any reduction in speed. The reduction in speed can significantly reduce the capacity of the segment of track and the velocity at which the locomotive can travel. Delaying the capacity and reducing the velocity leads to inefficient uses of the railway.

The present disclosure addresses the shortcomings of the traditional approach by splitting the segment of track into sections and providing virtual approach signals for each section, so the operators can rely on the virtual approach signals rather than the physical signaling components to set the speed of the locomotive. For example, the virtual approach signals can be used to identify an updated signal indicator allowing an increase speed while the locomotive is traveling along the segment of track. When the signal location receives the updated PTC enforcement signal while the locomotive is traveling along the segment of track, the virtual approach signals update allowing the operator to increase the speed of the locomotive significantly increasing capacity of the segment of track and velocity of the locomotive.

SUMMARY

The present disclosure achieves technical advantages as a system and method for providing a virtual approach signal restriction upgrade between physical signaling components. The present disclosure provides for a system integrated into a practical application with meaningful limitations capable of generating virtual approach signal indicators to increase an efficiency along a segment of track. In one embodiment, in a CTC type of operation, the use of a virtual signal with signal type functionality to split a block into two or more sections can allow a train currently governed by an approach indication to accelerate on a clear indication if the advance signal indication upgrades. The addition of audio frequency type circuits with the advance signal indication can allow a train to upgrade from a restricting indication to an approach or clear indication, while protecting open HT switches, broken rail, hazards, and follow up moves. Currently, rules are in place that allow a train to proceed with the advance PTC track line if it upgrades while on an approach. However, this rule will not allow a train to upgrade from a restricting PTC track line. The present invention provides a system for allowing trains to upgrade from a "restricting" indication to an "approach" or "clear and accelerate" indication with an upgraded PTC track line for the segment.

Additionally, the system can provide a signal for the locomotive to increase the speed at which the locomotive can travel along the segment of track based on the virtual approach signal indicators, rather than physical signal components. The system can provide enhanced safety along the segment of track by automating the virtual approach signal indicators for the locomotive. The automation can remove guess work by the operator as to whether the physical signaling component is accurate. The system and method can provide a reduced cost through the efficiency gains along the railway by upgrading the virtual approach signal to an all-clear indication removing any speed restrictions previously binding the locomotive. The system and method can provide a modular signaling ability to enhance a capacity along the segment of track.

Accordingly, the present disclosure discloses concepts inextricably tied to computer technology such that the present disclosure provides the technological benefit of virtualizing railway signaling technology. For example, based on PTC communication, the virtualization of signaling technology can enable a wayside system to communicate the updated indicator from the CTC system to the locomotive for display on a PTC onboard terminal. Additionally, the system can provide rapid downgrading of the virtual approach signal in response to hazardous railway events, such as a broken rail, hand-throw (HT) switch, or an occupied track. Alternatively, the system can provide rapid upgrading of the virtual approach signal in response to beneficial railway events, such as a clear track ahead or removal of any obstacles previously blocking the track.

The present disclosure provides a technological solution missing from conventional systems by at least providing virtual signaling components for operators to identify the status of the track prior to the locomotive reaching the physical signaling components. In this manner, the traditional approach is lacking an ability for the operator to verify an updated status of the track on which the locomotive is traveling. By restricting the operator to the traditional approaches, the operator is literally restricted from increasing the locomotive speed and can be less efficient in transportation. Ultimately, the segment of track can go underused for transporting locomotives, cargo, and passengers. The inefficiencies can devastate a railroad organization. The present disclosure avoids adding strain on an already overspent system by providing at least the following functionality:

- Upgrading a virtual approach signal along a segment of track in response to a physical status indicator of an electronic circuit monitoring the track ahead of a locomotive;
- Increasing a velocity with which the locomotives can travel and a capacity of locomotives allowed along the segment of track;
- Enhancing safety of operators, crew, and passengers by providing updated signaling according to current statuses of the segment of track; and
- Reducing costs to a railway organization by optimizing use of the segment of track and minimizing time spent idle for the locomotive.

It is an object of the invention to provide a method for providing virtual approach signaling between physical signaling components. It is a further object of the invention to provide a wayside system for providing virtual approach signaling between physical signaling components. It is a further object of the invention to provide a computer-implemented method for providing virtual approach signaling between physical signaling components. These and other objects are provided by at least the following embodiments.

In one embodiment, a method for operating a virtual approach signal, includes: determining a location of a train along a segment of track; generating virtual approach signal indications based on the location of the train; monitoring the segment of track for a railway event via an electronic circuit; displaying an approach virtual signal indication on a positive train control (PTC) locomotive onboard display when a signal location is a first signal indicator and the electronic circuit is energized; displaying a clear virtual signal indication on the PTC locomotive onboard display when the signal location is a second signal indicator and the electronic circuit is energized; displaying a restricting virtual signal indication on the PTC locomotive onboard display when the signal location is the first signal indicator or the second signal indicator and when the electronic circuit is not energized; and allowing an update to the virtual approach signal indications located in the segment of track using the electronic circuit along with an upgrade to the signal location. Wherein the electronic circuit includes an audio frequency circuit. Wherein the first signal indicator is red or flashing red. Wherein the second signal indicator is yellow, flashing yellow, or green. Wherein the method further comprises receiving an updated PTC advancement signal corresponding to the railway event; and updating the virtual approach signal indications in response to receiving the updated PTC advancement signal. Wherein the method further comprising upgrading, in response to the updated PTC advancement signal, the virtual approach signal indications from the restricting virtual signal indication to the approach virtual signal indication or the clear virtual signal indication. Wherein the method further comprising downgrading, in response to the updated PTC advancement signal, the virtual approach signal indications from the approach virtual signal indication or the clear virtual signal indication to the restricting virtual signal indication. Wherein the at least one virtual approach signal indicator corresponds to a mapping file. Wherein the railway event includes a broken rail, an occupied track, an unoccupied track, or a hand-throw switch. Wherein the method further comprising locating the virtual approach signal between the physical signaling components based on geolocation data.

In another embodiment, a wayside system for operating a virtual approach signal, configured to: determine a location of a train along a segment of track; generate virtual approach signal indications based on the location of the train; monitor the segment of track for a railway event via an electronic circuit; display an approach virtual signal indication on a positive train control (PTC) locomotive onboard display when a signal location is a first signal indicator and the electronic circuit is energized; display a clear virtual signal indication on the PTC locomotive onboard display when the signal location is a second signal indicator and the electronic circuit is energized; display a restricting virtual signal indication on the PTC locomotive onboard display when the signal location is the first signal indicator or the second signal indicator and if the electronic circuit is not energized; and allow an update to the virtual approach signal indications located in the segment of track using the electronic circuit along with an upgrade to the signal location. Wherein the electronic circuit includes an audio frequency circuit. Wherein the first signal indicator is red or flashing red. Wherein the second signal indicator is yellow, flashing yellow, or green. The system further configured to receive an updated PTC advancement signal corresponding to the railway event; and update the virtual approach signal indications in response to receiving the updated PTC advancement signal. The system further configured to upgrade, in response to the updated PTC advancement signal, the virtual approach signal indications from the restricting virtual signal indication to the approach virtual signal indication or the clear virtual signal indication. The system further configured to downgrade, in response to the updated PTC advancement signal, the virtual approach signal indications from the approach virtual signal indication or the clear virtual signal indication to the restricting virtual signal indication. Wherein the at least one virtual approach signal indicator corresponds to a mapping file. Wherein the railway event includes a broken rail, an occupied track, an unoccupied track, or a hand-throw switch. The system further configured to locate the virtual approach signal between the physical signaling components based on geolocation data.

In another embodiment, a computer-implemented method for operating a virtual approach signal, comprising: determining a location of a train along a segment of track; generating virtual approach signal indications based on the location of the train; monitoring the segment of track for a railway event via an electronic circuit; displaying an approach virtual signal indication on a positive train control (PTC) locomotive onboard display when a signal location is a first signal indicator and the electronic circuit is energized; displaying a clear virtual signal indication on the PTC locomotive onboard display when the signal location is a second signal indicator and the electronic circuit is energized; displaying a restricting virtual signal indication on the PTC locomotive onboard display when the signal location is the first signal indicator or the second signal indicator and if the electronic circuit is not energized; and allowing an update to the virtual approach signal indications located in the segment of track using the electronic circuit along with an upgrade to the signal location. Wherein the electronic circuit includes an audio frequency circuit. Wherein the first signal indicator is red or flashing red. Wherein the second signal indicator is yellow, flashing yellow, or green. The computer-implemented method further comprising: receiving an updated PTC advancement signal corresponding to the railway event; and updating the virtual approach signal indications in response to receiving the updated PTC advancement signal. The computer-implemented method further comprising upgrading, in response to the updated PTC advancement signal, the virtual approach signal indications from the restricting virtual signal indication to the approach virtual signal indication or the clear virtual signal indication. The computer-implemented method further comprising downgrading, in response to the updated PTC advancement signal, the virtual approach signal indications from the approach virtual signal indication or the clear virtual signal indication to the restricting virtual signal indication. Wherein the at least one virtual approach signal indicator corresponds to a mapping file. Wherein the railway event includes a broken rail, an occupied track, an unoccupied track, or a hand-throw switch. The computer-implemented method further comprising locating the virtual approach signal between the physical signaling components based on geolocation data.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, as evidenced by issuance of this patent, the prior art fails to disclose or teach the elements and limitations presented in the claims as enabled by the specification and drawings, such that the presented claims are patentable under the applicable laws and rules of this jurisdiction.

Figure 1:
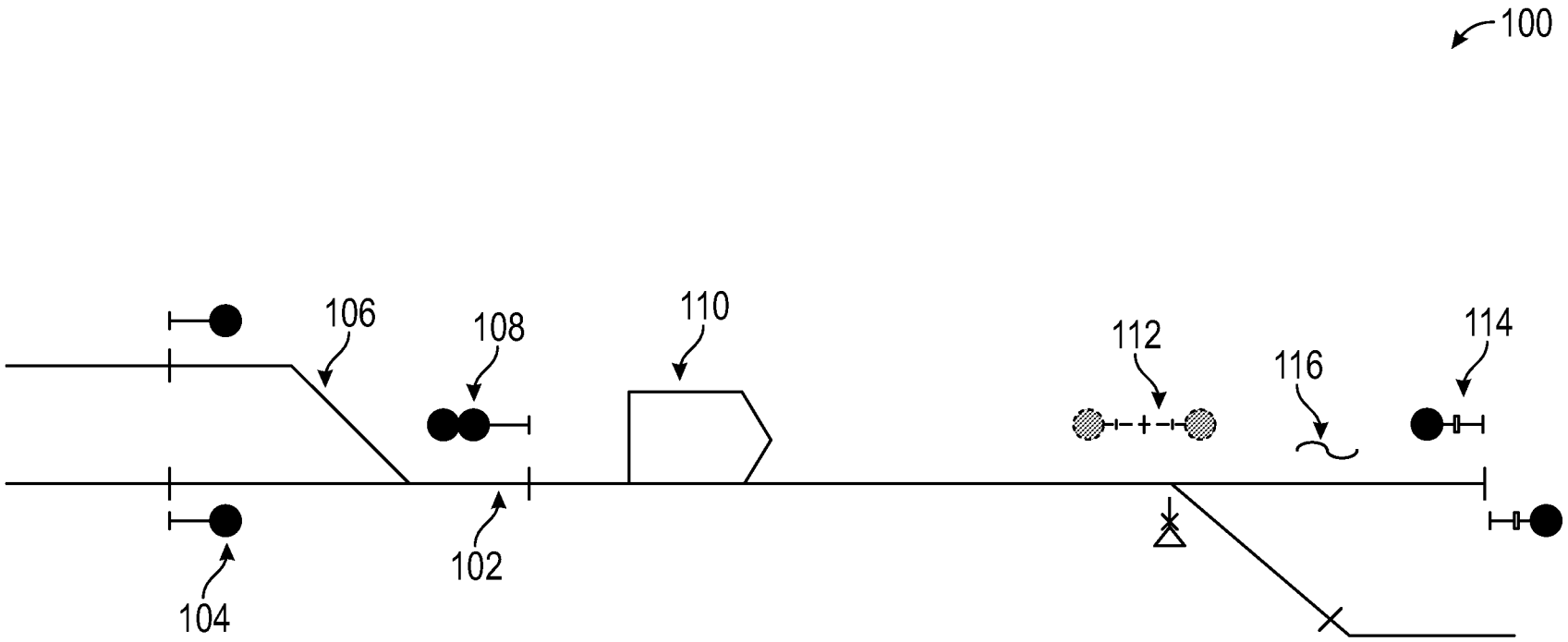
FIG. 1 illustrates a virtual approach signaling system, in accordance with one or more exemplary embodiments of the present disclosure.

The section of track depicted in FIGS. 1-3 represents physical track partially shown between absolute and intermediate signal locations. CTC guidance can control physical signals for each of the segments of track (e.g., 102, 202, and 302). CTC systems can consist of a centralized train dispatcher office that controls railroad interlockings and traffic flows in portions of the rail system designated as CTC territory. The CTC can include a control panel with a graphical depiction of the railroad. On this panel, the dispatcher can keep track of locations of various locomotives across the territory that the dispatcher controls. Expansive railroads can include multiple dispatcher offices and even multiple dispatchers for each operating division. In an embodiment, the segments of track can be separated by conventional rail joints with corresponding signal control houses, known as a wayside system. The wayside system can be associated with respective joints. Each wayside system can transmit on the track on both sides of a corresponding insulated joint. In one embodiment, each physical track segment can be partitioned using virtual approach signals. In the illustrated embodiment, these approach signals can be set using CTC by a railway organization using PTC communication methods, although in alternate embodiments, the number of virtual approach signals per physical track segment can vary. The track can continue with this convention indefinitely with wayside systems and additional sections of track.

In an embodiment, the CTC system applies railway signals to convey instructions from the dispatcher to the locomotives. The railway signals take the form of routing decisions at controlled points authorizing a train to proceed or stop. Local signaling logic at the signal locations will ultimately determine the exact signal to display based on track occupancy, status ahead, and the exact route the train needs to take, so the only input required from the CTC system amounts to the go, no-go instruction. Signals in CTC territory are one of two types: an absolute signal, which is directly controlled by the train dispatcher and helps design the limits of a control point, or an intermediate signal, which is automatically controlled by the conditions of the track and by the condition of the following signal. Train dispatchers cannot directly control intermediate signals and so are almost always excluded from the control display for the dispatcher except as an inert reference.

The majority of control points are equipped with remote control, power-operated switches. These switches often are dual-controlled switches, as they may be either remotely controlled by the train dispatcher or by manually operating a lever or pump on the switch mechanism itself (although the train dispatcher's permission is generally required to do so). These switches may lead to a passing siding, or they may take the form of a crossover, which allows movement to an adjacent track, or a "turnout" which routes a train to an alternate track (or route).

In an embodiment, the segments of track can include a track circuit. For example, the track circuit can include an electrical device to prove the absence of a train on the tracks to signal locations and control relevant signals. The basic principle behind the track circuit lies in the connection of the two rails of the track by the wheels and axle of locomotives to short an electrical circuit. This circuit is monitored by electrical equipment to detect the absence of the trains. Because this is a safety appliance, fail-safe operation is crucial. In an example, the circuit is designed to indicate the presence of a train when failures occur. On the other hand, false occupancy readings are disruptive to railway operations and must be minimized.

In another example, track circuits allow railway signaling systems to operate semi-automatically, by displaying signals for trains to slow or stop in the presence of occupied track ahead of them. The track circuits can assist in preventing dispatchers and operators from causing accidents, both by informing them of track occupancy and by preventing signals from displaying unsafe indications.

In the figures below, colors are represented in the figures as follows: green signals are black outline without any color filled in, yellow signals are black outline with gray fill, and red signals are black outline with black fill. In some embodiments, the virtual approach signals are indicated with a dashed outline to indicate the virtual nature of the element. The fences are visually represented as follows: yellow PTC fences are represented as forward slash hatching and red PTC fences are represented as backward slash hatching. In no way are the color transformations meant to be a limitation on any of the discussion below.

FIG. 1 illustrates an exemplary embodiment of a virtual approach signaling system 100. The combination of the CTC system and a locomotive with PTC functionality allow the ability to split the segment of track into two or more sections with a virtual approach signal. The virtual approach signaling system 100 can include a segment of track 102, an eastbound absolute signaling location 104, an approach location 106, a westbound absolute signaling location 108, a locomotive 110, a virtual approach signal 112, an intermediate signaling location 114, and an electronic circuit signal 116.

The segment of track 102, in an embodiment, can include a segment of railway on which a locomotive can travel. For example, the segment of track 102 can include physical railway assets such as rail, rail ties, ballast, spikes, and any other physical railway components to allow the locomotive to travel along the segment of track. In an example, the segment of track 102 can include electronic circuitry to transmit a signal across the rail to indicate various railway events. For example, the electronic circuitry can transmit an electronic signal across the rail and receive a response signal. The electronic circuitry can identify whether the rail is occupied by another locomotive, the rail is broken, or another type of railway event. In another example, the electronic circuitry can enable the PTC onboard terminal to update the virtual approach signal while the segment of track includes a restriction for locomotive travel. In another example, the segment of track 102 can include signals as a combination of absolute signals and intermediate signals.

The eastbound absolute signaling location 104, in an embodiment, can indicate to the locomotive a status of the segment of track along the eastbound direction of the locomotive. For example, absolute signals can protect traffic operations and of a CTC interlocking from hazardous events and can be under direct control by the dispatcher. A CTC interlocking location is often referred to as a control point. The most restrictive indication from the absolute signal is "stop," because proceeding past the signal can result in the locomotive entering directly into a route of another locomotive. For example, the "stop" indicator can include a red signal or flashing red signal.

The approach location 106, in an embodiment, can indicate an "approach" limit for the locomotive. For example, PTC operations limit a speed of the locomotive when the approach location 106 indicates an "approach" limit. In an example, the "approach" limit can indicate extra precaution when entering the segment of track. For example, the "approach" limit can indicate an increased probability of another locomotive entering the segment of track. While the locomotives must follow the requirements, human error can play a role in misjudging the traffic operations along the segment of track.

The westbound absolute signaling location 108, in an embodiment, can indicate to the locomotive a status of the segment of track along the westbound direction of another locomotive. For example, absolute signals can protect traffic operations and of a CTC interlocking from hazardous events and can be under direct control by the dispatcher. A CTC interlocking location is often referred to as a control point. The most restrictive indication from the absolute signal is "stop," because proceeding past the signal can result in the locomotive entering directly into a route of another locomotive. For example, the "stop" indicator can include a red signal or flashing red signal.

The locomotive 110, in an embodiment, can include a rail transport vehicle providing motive power to travel along the segment of track 102. For example, the locomotive 110 can include any type of rail transport vehicle traveling along the segment of track. In no way is the use of "locomotive" intended to be restrictive to a specific type of rail transport vehicle, rather "locomotive" is used to encompass the various rail transport vehicle to use the technology in the present disclosure. The locomotive 110 can include any rail transport vehicle. In another example, the locomotive 110 can include any rail transport vehicle including PTC capabilities. The locomotive 110 can include a PTC onboard terminal to process traffic operations along the segment of track. In another example, the PTC onboard terminal can display the signal indicators.

The virtual approach signal 112, in an embodiment, can include digitally generated indicators to display on the PTC onboard terminal. For example, the PTC onboard terminal can include a digital representation of the segment of track including the various absolute signals and intermediate signals. The PTC onboard terminal can include the virtual approach signal 112 as a signaling component between physical signaling components. The virtual approach signal 112 can indicate signal identifiers corresponding to the signal location. For example, if the signal location includes a red signal indicator or flashing red signal indicator, the virtual approach signal 112 can include a yellow signal indicator. The yellow signal indicator can communicate to the operator the locomotive is to reduce speed in the next segment of track. Alternatively, if the signal location includes a yellow signal indicator, flashing yellow signal indicator, or green signal indicator, the virtual approach signal 112 can include a green signal indicator. The green signal indicator can communicate to the operator the locomotive can travel at full speed in the next segment of track. In another example, the segment of track can include a plurality of virtual approach signals. For example, the segment of track can include as many virtual approach signals applicable for safety requirements. In another example, the segment of track can include the virtual approach signal 112 at a particular location along the segment of track. The particular location can correspond to global positioning system (GPS) data, geographic information system (GIS) data, latitude-longitude data, milepost data, or any other type of geolocation data relevant to the virtual approach signal 112.

The intermediate signaling location 114, in an embodiment, can provide automatic signaling based on absolute signals (e.g., the eastbound absolute signaling location 104). Intermediate signals are found on the line between control points. The intermediate signals cannot be directly controlled by the dispatcher. Intermediate signals normally display "Stop then Proceed" as their most restrictive aspect. The intermediate signal in CTC territory will always authorize a train to continue.

The electronic circuit signal 116, in an embodiment, can signal to the locomotive 110 to accelerate based on a less restrictive signal indication. For example, if the advance signal indication upgrades from stop or restricting aspects, an electronic circuit can determine whether the locomotive can safely travel on the segment of track based on a railway event. In an example, the electronic circuit can determine whether the railway event results in an occupied track. The electronic circuit can energize electrical hardware to indicate to the locomotive the restricting aspect is clear. In an example, the electronic circuit can apply power to each rail and a relay coil wired across them. When no train is present along the track, a relay is energized by the current flowing from the power source through the rails. When a train is present along the track, its axles short (shunt) the rails together and the current to the track relay coil drops, and it is de-energized. In an example, the electronic circuit, through the relay contacts can report whether or not the track is occupied. The electronic circuit can detect a defined section of track, such as a block. In an example, the sections of track are separated by insulated joints, usually in both rails. In another example, the electronic circuit can include electrical power at low voltages (1.5 to 12 volts-direct current). In another example, the relays and the power supply are attached to opposite ends of the section to prevent broken rails from electrically isolating part of the track from the circuit. A series resistor limits the current when the track circuit is short-circuited. the electronic circuit can generate and transmit the electronic circuit signal 116. In another example, the electronic circuit can include an audio frequency circuit.

Figure 2A:
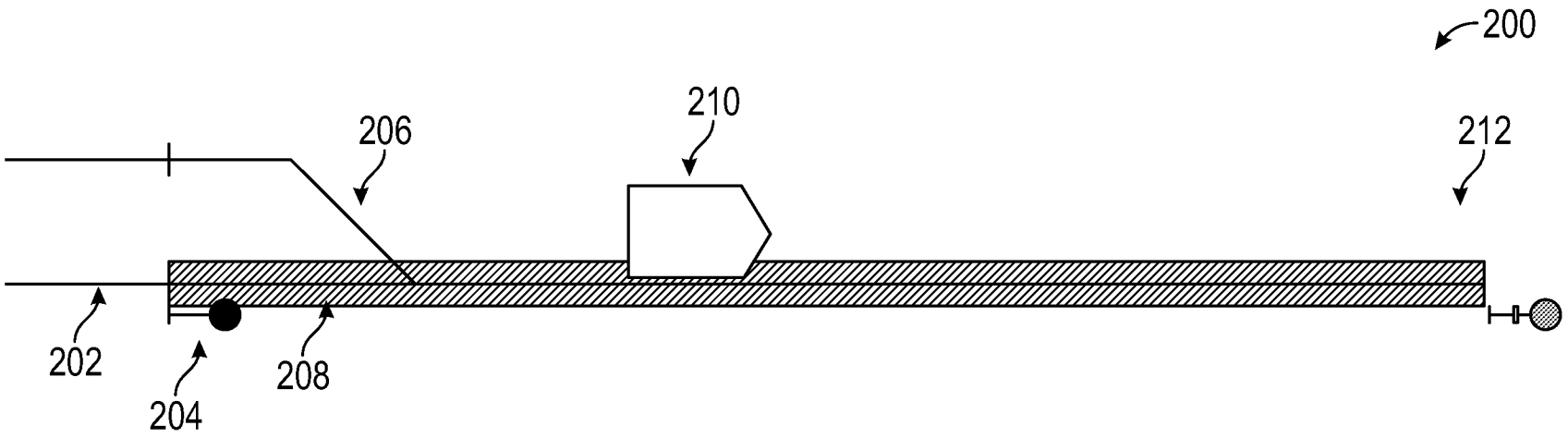
FIGS. 2A and 2B illustrate a virtual approach signaling system, in accordance with one or more exemplary embodiments of the present disclosure.
Figure 2B:
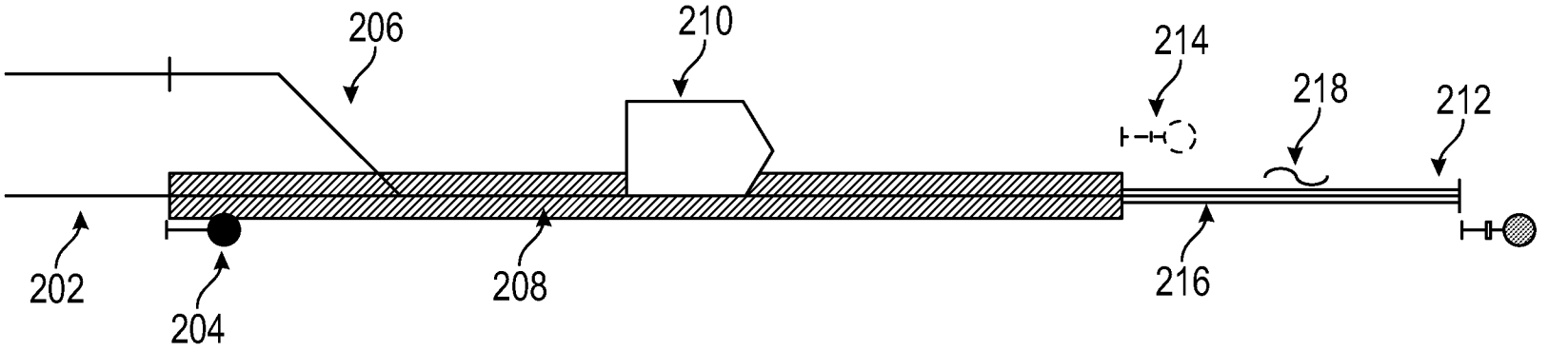

FIGS. 2A and 2B illustrate an exemplary embodiment of a virtual approach signaling system 200. The combination of the CTC system and a locomotive with PTC functionality allow the ability to split the segment of track into two or more sections with a virtual approach signal. The virtual approach signaling system 200 illustrates an event when the segment of track lacks any virtual approach signal. In an example, the virtual approach signaling system 200 can include a segment of track 202, an absolute signaling location 204, an approach location 206, a PTC enforcement response 208, a locomotive 210, an intermediate signaling location 212, a virtual approach signal 214, a PTC virtual approach enforcement response 216, and an electronic circuit signal 218.

The segment of track 202, in an embodiment, can include a segment of railway on which a locomotive can travel. For example, the segment of track 202 can include physical railway assets such as rail, rail ties, ballast, spikes, and any other physical railway components to allow the locomotive to travel along the segment of track. In an example, the segment of track 202 can include electronic circuitry to transmit a signal across the rail to indicate various railway events. For example, the electronic circuitry can transmit an electronic signal across the rail and receive a response signal. The electronic circuitry can identify whether the rail is occupied by another locomotive, the rail is broken, or another type of railway event. In another example, the electronic circuitry can enable the PTC onboard terminal to update the virtual approach signal while the segment of track includes a restriction for locomotive travel. In another example, the segment of track 202 can include signals as a combination of absolute signals and intermediate signals.

The absolute signaling location 204, in an embodiment, can indicate to the locomotive a status of the segment of track along the eastbound direction of the locomotive. For example, absolute signals can protect traffic operations and of a CTC interlocking from hazardous events and can be under direct control by the dispatcher. A CTC interlocking location is often referred to as a control point. The most restrictive indication from the absolute signal is "stop," because proceeding past the signal can result in the locomotive entering directly into a route of another locomotive. For example, the "stop" indicator can include a red signal or flashing red signal.

The approach location 206, in an embodiment, can indicate an "approach" limit for the locomotive. For example, PTC operations limit a speed of the locomotive when the approach location 206 indicates an "approach" limit. In an example, the "approach" limit can indicate extra precaution when entering the segment of track. For example, the "approach" limit can indicate an increased probability of another locomotive entering the segment of track. While the locomotives must follow the requirements, human error can play a role in misjudging the traffic operations along the segment of track.

The PTC enforcement response 208, in an embodiment, can indicate to the locomotive a status of the segment of track. For example, the PTC enforcement response 208 can include a physical indicator in response to an indicator of the intermediate signaling location 212. In an example, the intermediate signaling location 212 can indicate a restriction in speed, which can be represented as a restricting fence along the segment of track. For example, a PTC onboard terminal can display the segment of track without an ability to upgrade. In an example, the restricting fence can correspond to part of the segment of track based on the virtual approach signal. In an example, the virtual approach signal can indicate various statuses for the next segment of track. The restricting fence can correspond to a restriction in locomotive speed is in effect along the segment of track.

The locomotive 210, in an embodiment, can include a rail transport vehicle providing motive power to travel along the segment of track 202. For example, the locomotive 210 can include any type of rail transport vehicle traveling along the segment of track. In no way is the use of "locomotive" intended to be restrictive to a specific type of rail transport vehicle, rather "locomotive" is used to encompass the various rail transport vehicle to use the technology in the present disclosure. The locomotive 210 can include any rail transport vehicle. In another example, the locomotive 210 can include any rail transport vehicle including PTC capabilities. The locomotive 210 can include a PTC onboard terminal to process traffic operations along the segment of track. In another example, the PTC onboard terminal can display the signal indicators.

The intermediate signaling location 212, in an embodiment, can provide automatic signaling based on absolute signals (e.g., the absolute signaling location 204). Intermediate signals are found on the line between control points. The intermediate signals cannot be directly controlled by the dispatcher. Intermediate signals normally display "Stop then Proceed" as their most restrictive aspect. The intermediate signal in CTC territory will always authorize a train to continue.

The virtual approach signal 214, in an embodiment, can include digitally generated indicators to display on the PTC onboard terminal. For example, the PTC onboard terminal can include a digital representation of the segment of track including the various absolute signals and intermediate signals. The PTC onboard terminal can include the virtual approach signal 214 as a signaling component between physical signaling components. The virtual approach signal 214 indicates signal identifiers corresponding to the signal location. For example, if the signal location includes a red signal indicator or flashing red signal indicator, the virtual approach signal 214 can include a yellow signal indicator. The yellow signal indicator can communicate to the operator the locomotive is to reduce speed in the next segment of track. Alternatively, if the signal location includes a yellow signal indicator, flashing yellow signal indicator, or green signal indicator, the virtual approach signal 214 can include a green signal indicator. The green signal indicator can communicate to the operator the locomotive can travel at full speed in the next segment of track. In another example, the segment of track can include a plurality of virtual approach signals. For example, the segment of track can include as many virtual approach signals applicable for safety requirements. In another example, the segment of track can include the virtual approach signal 214 at a particular location along the segment of track. The particular location can correspond to GPS data, GIS data, latitude-longitude data, milepost data, or any other type of geolocation data relevant to the virtual approach signal 214.

The PTC virtual approach enforcement response 216, in an embodiment, can indicate to the locomotive 210 the next segment of track after the virtual approach signal 214 is all clear. For example, the all clear indication can signal to the locomotive 210 to travel at full speed. In an example, the PTC virtual approach enforcement response 216 can correspond to the intermediate signaling location 212. For example, when the intermediate signaling location 212 indicates an "approach" limit, the PTC virtual approach enforcement response 216 can indicate an all clear signal allowing the locomotive 210 to travel at full speed through the next segment of track. Alternatively, when the intermediate signaling location 212 indicates a "stop" restriction, the PTC virtual approach enforcement response 216 can indicate a restriction signal resulting in the locomotive 210 reducing its speed along the next segment of track.

The electronic circuit signal 218, in an embodiment, can signal to the locomotive to accelerate on a less restrictive indication. For example, if the advance signal indication upgrades from stop or restricting aspects, an electronic circuit can determine whether the locomotive can safely travel on the segment of track based on a railway event. In an example, the electronic circuit can determine whether the railway event results in an occupied track. The electronic circuit can energize electrical hardware to indicate to the locomotive the restricting aspect is clear. In an example, the electronic circuit can apply power to each rail and a relay coil wired across them. When no train is present along the track, the relay is energized by the current flowing from the power source through the rails. When a train is present along the track, its axles short (shunt) the rails together and the current to the track relay coil drops, and it is de-energized. In an example, the electronic circuit, through the relay contacts can report whether or not the track is occupied. The electronic circuit can detect a defined section of track, such as a block. In an example, the sections of track are separated by insulated joints, usually in both rails. In another example, the electronic circuit can include electrical power at low voltages (1.5 to 12 volts-direct current). In another example, the relays and the power supply are attached to opposite ends of the section to prevent broken rails from electrically isolating part of the track from the circuit. A series resistor limits the current when the track circuit is short-circuited. the electronic circuit can generate and transmit the electronic circuit signal 216. In another example, the electronic circuit can include an audio frequency circuit.

Referring to FIG. 2A, the locomotive 210 can travel along the segment of track 202 passing the approach location 206 and the absolute signal 204. The segment of track 202 lacks a virtual approach signal, leaving the locomotive 210 to travel at reduced speed for the entire segment.

Referring to FIG. 2B, the locomotive 210 can travel along the segment of track 202 passing the approach location 206 and the absolute signal 204. The locomotive 210 approaches the virtual approach signal 214, signaling to the locomotive to travel at full speed when the locomotive 210 reaches a location of the virtual approach signal 214 in response to an energized state of the electronic circuit 218.

Figure 3A:
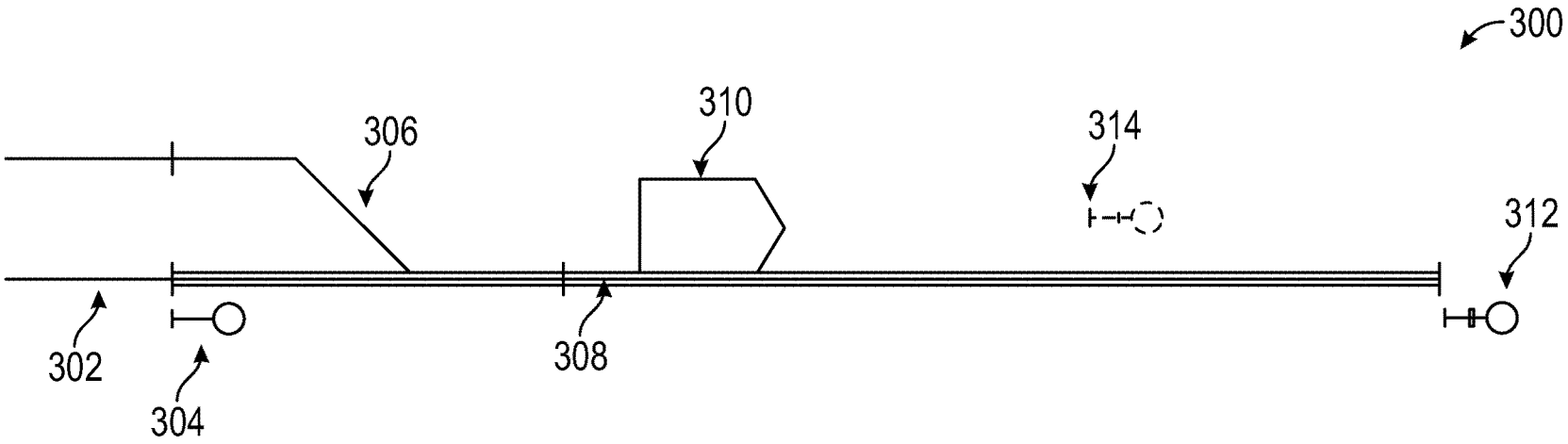
FIGS. 3A and 3B illustrate a virtual approach signaling system, in accordance with one or more exemplary embodiments of the present disclosure.
Figure 3B:
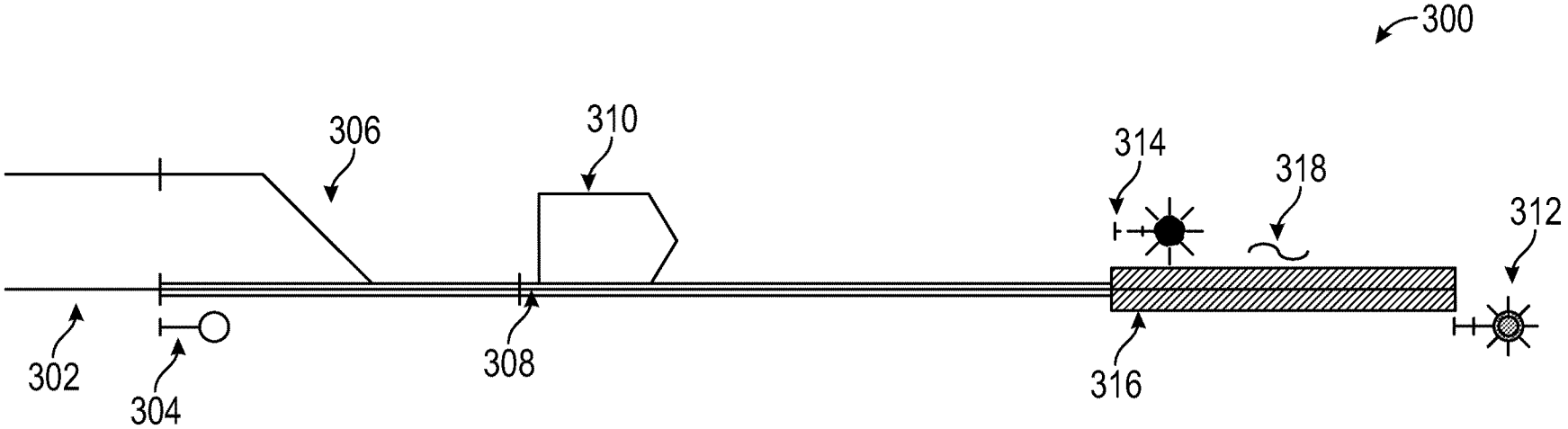

FIGS. 3A and 3B illustrate an exemplary embodiment of a virtual approach signaling system 300. The combination of the CTC system and a locomotive with PTC functionality allow the ability to split the segment of track into two or more sections with a virtual approach signal. The virtual approach signaling system 300 illustrates an event when the segment of track lacks any virtual approach signal. In an example, the virtual approach signaling system 300 can include a segment of track 302, an absolute signaling location 304, an approach location 306, a PTC enforcement response 308, a locomotive 310, an intermediate signaling location 312, a virtual approach signal 314, a PTC virtual approach enforcement response 316, and an electronic circuit signal 318.

The segment of track 302, in an embodiment, can include a segment of railway on which a locomotive can travel. For example, the segment of track 302 can include physical railway assets such as rail, rail ties, ballast, spikes, and any other physical railway components to allow the locomotive to travel along the segment of track. In an example, the segment of track 302 can include electronic circuitry to transmit a signal across the rail to indicate various railway events. For example, the electronic circuitry can transmit an electronic signal across the rail and receive a response signal. The electronic circuitry can identify whether the rail is occupied by another locomotive, the rail is broken, or another type of railway event. In another example, the electronic circuitry can enable the PTC onboard terminal to update the virtual approach signal while the segment of track includes a restriction for locomotive travel. In another example, the segment of track 302 can include signals as a combination of absolute signals and intermediate signals.

The absolute signaling location 304, in an embodiment, can indicate to the locomotive a status of the segment of track along the eastbound direction of the locomotive. For example, absolute signals can protect traffic operations and of a CTC interlocking from hazardous events and can be under direct control by the dispatcher. A CTC interlocking location is often referred to as a control point. The most restrictive indication from the absolute signal is "stop," because proceeding past the signal can result in the locomotive entering directly into a route of another locomotive. For example, the "stop" indicator can include a red signal or flashing red signal.

The approach location 306, in an embodiment, can indicate an "approach" limit for the locomotive. For example, PTC operations limit a speed of the locomotive when the approach location 306 indicates an "approach" limit. In an example, the "approach" limit can indicate extra precaution when entering the segment of track. For example, the "approach" limit can indicate an increased probability of another locomotive entering the segment of track. While the locomotives must follow the requirements, human error can play a role in misjudging the traffic operations along the segment of track.

The PTC enforcement response 308, in an embodiment, can indicate to the locomotive a status of the segment of track. For example, the PTC enforcement response 308 can include a physical indicator in response to an indicator of the intermediate signaling location 312. In an example, the intermediate signaling location 312 can indicate full speed allowed, which can be represented as an all clear along the segment of track. For example, a PTC onboard terminal can display the segment of track without an ability to downgrade. In an example, the all clear signal can correspond to part of the segment of track based on the virtual approach signal. In an example, the virtual approach signal can indicate various statuses for the next segment of track. The restricting fence can correspond to a restriction in locomotive speed is in effect along the segment of track.

The locomotive 310, in an embodiment, can include a rail transport vehicle providing motive power to travel along the segment of track 302. For example, the locomotive 310 can include any type of rail transport vehicle traveling along the segment of track. In no way is the use of "locomotive" intended to be restrictive to a specific type of rail transport vehicle, rather "locomotive" is used to encompass the various rail transport vehicle to use the technology in the present disclosure. The locomotive 310 can include any rail transport vehicle. In another example, the locomotive 310 can include any rail transport vehicle including PTC capabilities. The locomotive 310 can include a PTC onboard terminal to process traffic operations along the segment of track. In another example, the PTC onboard terminal can display the signal indicators.

The intermediate signaling location 312, in an embodiment, can provide automatic signaling based on absolute signals (e.g., the absolute signaling location 304). Intermediate signals are found on the line between control points. The intermediate signals cannot be directly controlled by the dispatcher. Intermediate signals normally display "Stop then Proceed" as their most restrictive aspect. The intermediate signal in CTC territory will always authorize a train to continue.

The virtual approach signal 314, in an embodiment, can include digitally generated indicators to display on the PTC onboard terminal. For example, the PTC onboard terminal can include a digital representation of the segment of track including the various absolute signals and intermediate signals. The PTC onboard terminal can include the virtual approach signal 314 as a signaling component between physical signaling components. The virtual approach signal 314 indicates signal identifiers corresponding to the signal location. For example, if the signal location includes a red signal indicator or flashing red signal indicator, the virtual approach signal 314 can include a yellow signal indicator. The yellow signal indicator can communicate to the operator the locomotive is to reduce speed in the next segment of track. Alternatively, if the signal location includes a yellow signal indicator, flashing yellow signal indicator, or green signal indicator, the virtual approach signal 314 can include a green signal indicator. The green signal indicator can communicate to the operator the locomotive can travel at full speed in the next segment of track. In another example, the segment of track can include a plurality of virtual approach signals. For example, the segment of track can include as many virtual approach signals applicable for safety requirements. In another example, the segment of track can include the virtual approach signal 314 at a particular location along the segment of track. The particular location can correspond to GPS data, GIS data, latitude-longitude data, milepost data, or any other type of geolocation data relevant to the virtual approach signal 314.

The PTC virtual approach enforcement response 316, in an embodiment, can indicate to the locomotive 310 the next segment of track after the virtual approach signal 314 is a restricted speed. For example, the restricted speed indication can signal to the locomotive 310 to travel at a restricted speed. In an example, the PTC virtual approach enforcement response 316 can correspond to the intermediate signaling location 312. For example, when the intermediate signaling location 312 indicates a "stop" restriction, the PTC virtual approach enforcement response 316 can indicate the restricted speed signal allowing the locomotive 310 to travel at restricted speed through the next segment of track. Alternatively, when the intermediate signaling location 312 indicates an "approach" or "clear" indication, the PTC virtual approach enforcement response 316 can indicate a clear signal resulting in the locomotive 310 increasing its speed along the next segment of track.

The electronic circuit signal 318, in an embodiment, can signal to the locomotive to accelerate on a less restrictive indication. For example, if the advance signal indication upgrades from stop or restricting aspects, an electronic circuit can determine whether the locomotive can safely travel on the segment of track based on a railway event. In an example, the electronic circuit can determine whether the railway event results in an occupied track. For example, the electronic circuit can energize electrical hardware to indicate to the locomotive the restricting aspect is clear. In an example, the electronic circuit can apply power to each rail and a relay coil wired across them. When no train is present along the track, the relay is energized by the current flowing from the power source through the rails. When a train is present along the track, its axles short (shunt) the rails together and the current to the track relay coil drops, and it is de-energized. In an example, the electronic circuit, through the relay contacts can report whether or not the track is occupied. The electronic circuit can detect a defined section of track, such as a block. In an example, the sections of track are separated by insulated joints, usually in both rails. In another example, the electronic circuit can include electrical power at low voltages (1.5 to 12 volts-direct current). In another example, the relays and the power supply are attached to opposite ends of the section to prevent broken rails from electrically isolating part of the track from the circuit. A series resistor limits the current when the track circuit is short-circuited. the electronic circuit can generate and transmit the electronic circuit signal 316. In another example, the electronic circuit can include an audio frequency circuit.

Referring to FIG. 3A, the locomotive 310 can travel along the segment of track 302 passing the approach location 306 and the absolute signal 304. The segment of track 302 approaches the virtual approach signal 314 indicating the segment of track is all clear ahead of the locomotive 310.

Referring to FIG. 3B, the locomotive 310 can travel along the segment of track 302 passing the approach location 306 and the absolute signal 304. The locomotive 310 approaches the virtual approach signal 314, signaling to the locomotive to travel at restricted speed when the locomotive 310 reaches a location of the virtual approach signal 314 in response to a de-energized state of the electronic circuit 318.

Figure 4:
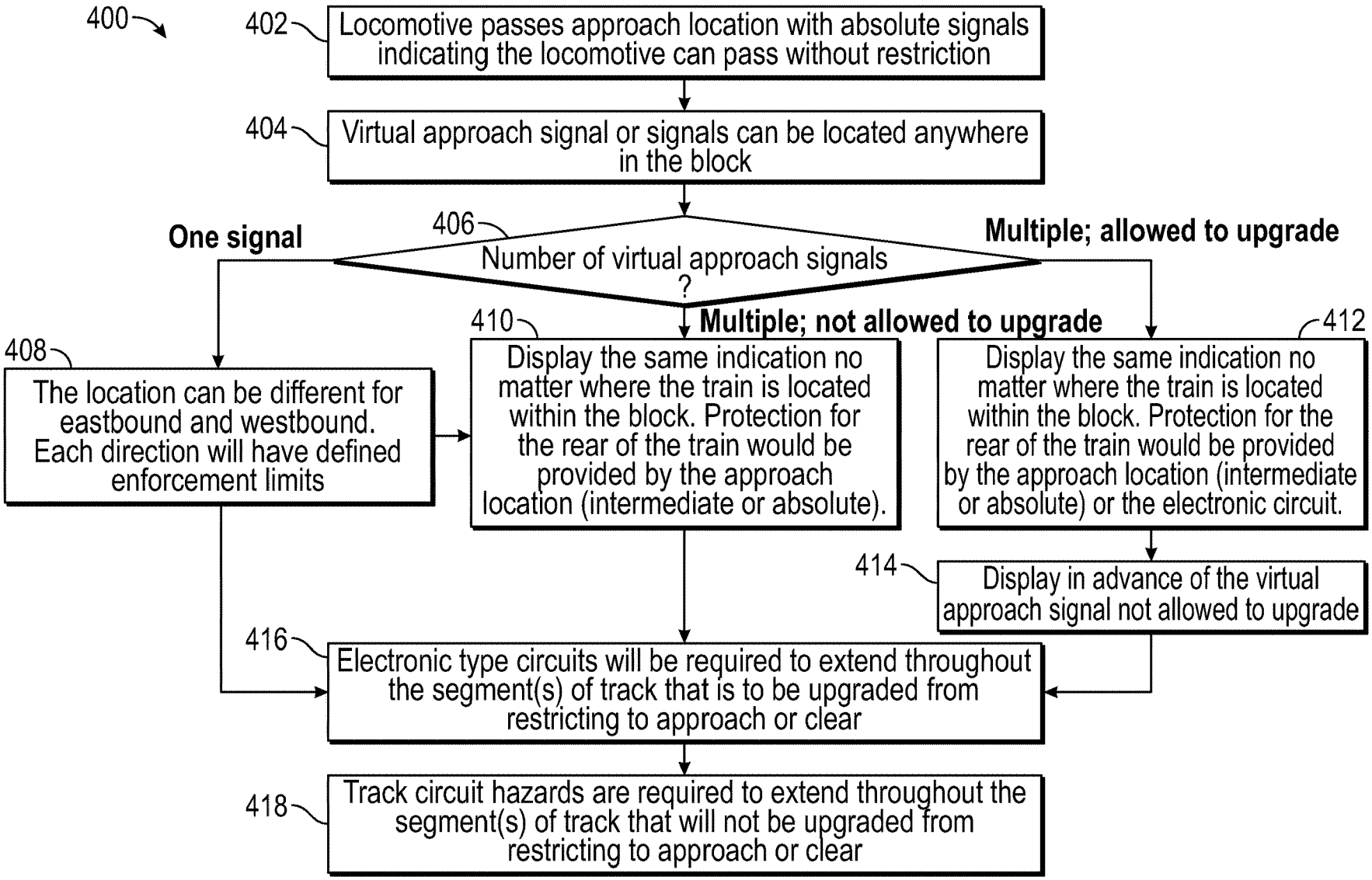
FIG. 4 illustrates a flowchart of a process for virtual approach signaling, in accordance with one or more exemplary embodiments of the present disclosure.

FIG. 4 is flowchart exemplifying a process for virtual approach signaling 400, in accordance with at least one embodiment of the present disclosure. The process for virtual approach signaling 400 can be implemented as an algorithm on a computer processor (e.g., logic controller, onboard computer, PTC onboard terminal, server, etc.), a machine learning module, or other suitable system. Additionally, the process for virtual approach signaling 400 can be achieved with software, hardware, an API, a network connection, a network transfer protocol, HTML, DHTML, JavaScript, Dojo, Ruby, Rails, other suitable applications, or a suitable combination thereof. The process for virtual approach signaling 400 implementing hardware components (e.g., computer processor) can be capable of executing machine-readable instructions to perform program steps and operably coupled to a memory having a first database with a plurality of messages, signal values, and specifications related to a vehicle and at least a portion of a track.

The process for virtual approach signaling 400 can leverage the ability of a computer platform to spawn multiple processes and threads by processing data simultaneously. The speed and efficiency of the process for virtual approach signaling 400 can be greatly improved by instantiating more than one process for responding to a track hazard. However, one skilled in the art of programming will appreciate that use of a single processing thread may also be utilized and is within the scope of the present disclosure. The process for virtual approach signaling 400 can also be distributed amongst a plurality of networked computer processors. The computer processors can be located in wayside systems or onboard the train (e.g., 110, 210, 310, etc.). The process for virtual approach signaling 400 of the present embodiment begins at step 402.

At step 402, in an embodiment, the process 400 can enable a locomotive to pass an approach location corresponding to absolute signals indicating the locomotive can pass without restriction. For example, the approach locations can include physical signal components indicating to a locomotive on a segment of track the next segment of track is clear. In an example, the physical signal components can include various colored lights either solid in color or flashing. In another example, the various colored lights can include green, yellow, or red. In an example, the restriction can include railway events resulting in an impasse along the segment of track. For example, the restriction can include a broken rail along the segment of track, or the segment of track includes another locomotive rendering the track occupied. In another example, the absolute signal can include signal indicators for which the locomotive operator can adhere. For example, the absolute signals can include signal indicators as a flashing red indicator, where the locomotive operator will stop the locomotive on the segment of track and avoid passing the approach location. The process 400 then proceeds to step 404.

At step 404, in an embodiment, the process 400 can include virtual approach signal located anywhere in a segment of track (i.e., the block). For example, the virtual approach signal can reside at any location along the segment of track. In an example, the process 400 can include a plurality of virtual approach signals located anywhere in the segment of track. In another example, when a single virtual approach signal is along the segment of track, the location of the virtual approach signal can be different for an eastbound direction of travel and a westbound direction of travel. Each direction can include defined enforcement limits. In an example, the location of the virtual approach signal is based on geolocation data. In another example, the geolocation data can include GPS data or GIS data. The location of the virtual approach signal can be based on input from a PTC coordinator, such as a railway organization. The virtual approach signal or signals can be based on an optimization metric set by the PTC coordinator. The optimization metric can be based on the use of the segment of track. For example, when the segment of track is used for passenger travels, the optimization metric can include a minimum number of virtual approach signals to adhere to stricter safety regulations. Alternatively, when the segment of track is used for cargo transportation, the optimization metric can include a maximum number of virtual approach signals to ensure rapid transit. The process 400 then proceeds to step 406.

At step 406, in an embodiment, the process 400 can determine a number of virtual approach signals. For example, the segment of track can include at least one virtual approach signal. In an example, each of the virtual approach signals can include authority to upgrade the travel speed of the locomotive. The authority for the virtual approach signals can be from the organization generating instructions for the CTC and PTC. If the segment of track includes one virtual approach signal, the process 400 then proceeds to step 408. If the segment of track includes more than one virtual approach signal and the signals are not allowed to upgrade, the process 400 then proceeds to step 410. If the segment of track includes more than one virtual approach signal and the signals are allowed to upgrade, the process 400 then proceeds to step 412.

At step 408, in an embodiment, the process 400 can include different locations of the virtual approach signal for eastbound and westbound directions of travel. For example, each direction of travel will have defined enforcement limits. In an example, the virtual approach signal for the eastbound direction of travel can include half the segment of track, such that the segment of track is divided into two sections. Travel along the first section can be governed by the virtual approach signal and travel along the second section can be governed by the signal location, intermediate signal, or absolute signal. The process 400 then proceeds to step 416.

At step 410, in an embodiment, the process 400 can display the same indication no matter where the train is located within the block. For example, each of the virtual approach signals can display the same indication on the PTC onboard terminal. In this way, the virtual approach signals can provide protection for the rear of the train would when the locomotive arrives at the next approach location. In another example, the next approach location can include an intermediate signal or an absolute signal. The process 400 then proceeds to step 416.

At step 412, in an embodiment, the process 400 can display the same indication no matter where the train is located within the block. For example, each of the virtual approach signals can display the same indication on the PTC onboard terminal. In this way, the virtual approach signals can provide protection for the rear of the train would when the locomotive arrives at the next approach location. In another example, the next approach location can include an intermediate signal, an absolute signal, a next electronic circuit (i.e., for the next segment or section of track). The virtual approach signals can provide protection for the rear of the train by displaying an occupied track on the PTC onboard terminal. The process 400 then proceeds to step 414.

At step 414, in an embodiment, the process 400 can display the upgrade in status of the segment of track for the virtual approach signals allowed to upgrade. In an example, the process 400 can display the upgrade for the virtual approach signals in advance of displaying any indication for the virtual approach signals that are not allowed to upgrade. The process 400 then proceeds to step 416.

At step 416, in an embodiment, the process 400 can include at least one electronic circuits extending throughout the segment of track. For example, the electronic circuit can indicate to the virtual approach signals to be upgraded from restricting to an approach or a clear aspect. In an example, the electronic circuit can include a track circuit hazard across the segment of track. The process 400 then proceeds to step 418.

At step 418, in an embodiment, the process 400 can include at least one track circuit hazard extended throughout the segment of track. For example, the track circuit hazard can be part of the electronic circuit and indicate whether a track hazard exists for the segment of track. In an example, the track circuit hazard can indicate the virtual approach signal may not be upgraded from restricting to an approach or a clear aspect.

Figure 5:
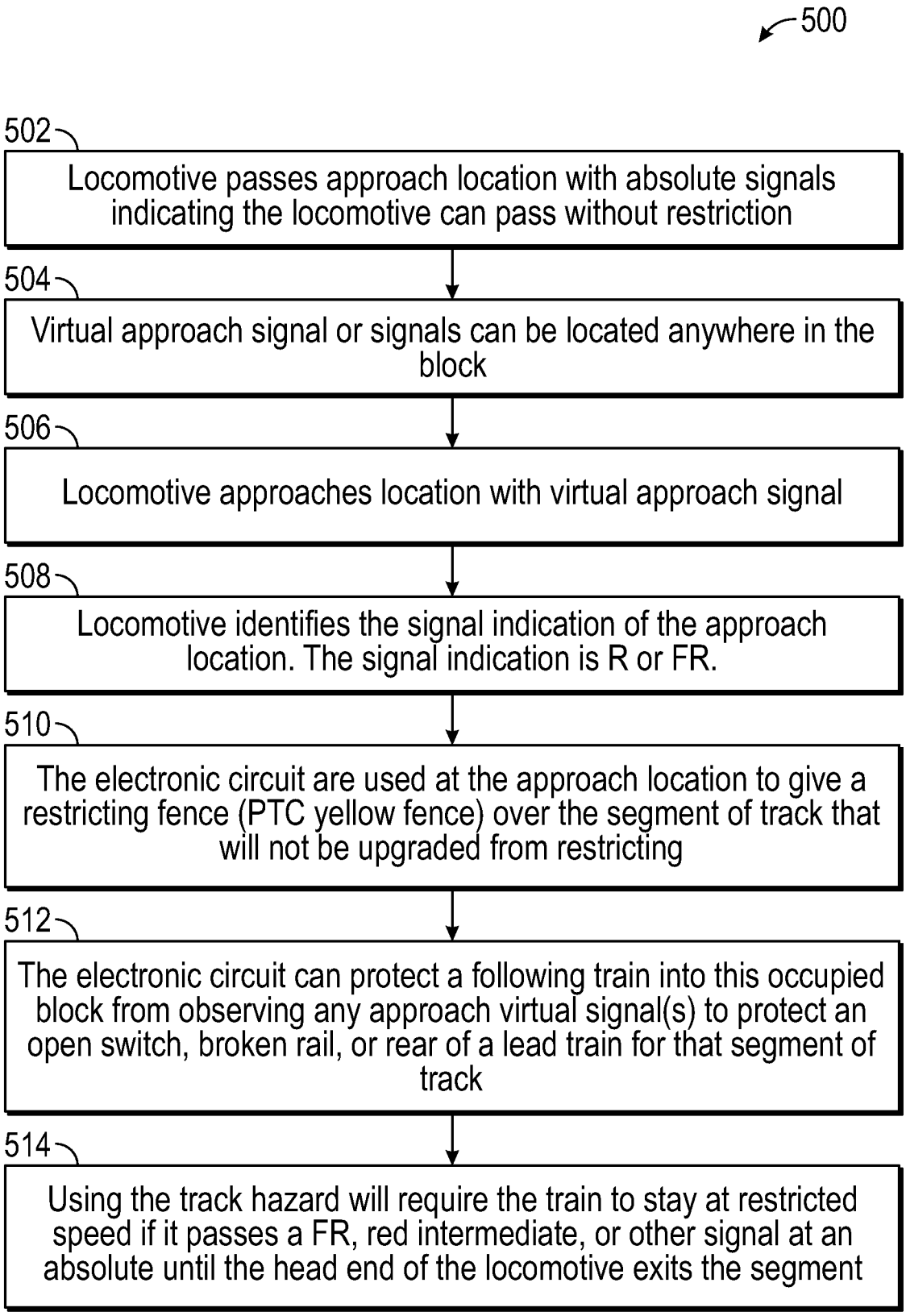
FIG. 5 illustrates a flowchart of a process for virtual approach signaling, in accordance with one or more exemplary embodiments of the present disclosure.

FIG. 5 illustrates a flowchart exemplifying a process for virtual approach signaling 500, in accordance with at least one embodiment of the present disclosure. The process for virtual approach signaling 500 can be implemented as an algorithm on a computer processor (e.g., logic controller, onboard computer, PTC onboard terminal, server, etc.), a machine learning module, or other suitable system. Additionally, the process for virtual approach signaling 500 can be achieved with software, hardware, an API, a network connection, a network transfer protocol, HTML, DHTML, JavaScript, Dojo, Ruby, Rails, other suitable applications, or a suitable combination thereof. The process for virtual approach signaling 500 implementing hardware components (e.g., computer processor) can be capable of executing machine-readable instructions to perform program steps and operably coupled to a memory having a first database with a plurality of messages, signal values, and specifications related to a vehicle and at least a portion of a track.

The process for virtual approach signaling 500 can leverage the ability of a computer platform to spawn multiple processes and threads by processing data simultaneously. The speed and efficiency of the process for virtual approach signaling 500 can be greatly improved by instantiating more than one process for responding to a track hazard. However, one skilled in the art of programming will appreciate that use of a single processing thread may also be utilized and is within the scope of the present disclosure. The process for virtual approach signaling 500 can also be distributed amongst a plurality of networked computer processors. The computer processors can be located in wayside systems or onboard the train (e.g., 110, 210, 310, etc.). The process for virtual approach signaling 500 of the present embodiment begins at step 502.

At step 502, in an embodiment, the process 500 can enable a locomotive to pass an approach location corresponding to absolute signals indicating the locomotive can pass without restriction. For example, the approach locations can include physical signal components indicating to a locomotive on a segment of track the next segment of track is clear. In an example, the physical signal components can include various colored lights either solid in color or flashing. In another example, the various colored lights can include green, yellow, or red. In an example, the restriction can include railway events resulting in an impasse along the segment of track. For example, the restriction can include a broken rail along the segment of track, or the segment of track includes another locomotive rendering the track occupied. In another example, the absolute signal can include signal indicators for which the locomotive operator can adhere. For example, the absolute signals can include signal indicators as a flashing red indicator, where the locomotive operator will stop the locomotive on the segment of track and avoid passing the approach location. The process 500 then proceeds to step 504.

At step 504, in an embodiment, the process 500 can include virtual approach signal located anywhere in a segment of track (i.e., the block). For example, the virtual approach signal can reside at any location along the segment of track. In an example, the process 500 can include a plurality of virtual approach signals located anywhere in the segment of track. In another example, when a single virtual approach signal is along the segment of track, the location of the virtual approach signal can be different for an eastbound direction of travel and a westbound direction of travel. Each direction can include defined enforcement limits. In an example, the location of the virtual approach signal is based on geolocation data. In another example, the geolocation data can include GPS data or GIS data. The location of the virtual approach signal can be based on input from a PTC coordinator, such as a railway organization. The virtual approach signal or signals can be based on an optimization metric set by the PTC coordinator. The optimization metric can be based on the use of the segment of track. For example, when the segment of track is used for passenger travels, the optimization metric can include a minimum number of virtual approach signals to adhere to stricter safety regulations. Alternatively, when the segment of track is used for cargo transportation, the optimization metric can include a maximum number of virtual approach signals to ensure rapid transit. The process 500 then proceeds to step 506.

At step 506, in an embodiment, the process 500 can include the locomotive approaching the location of the virtual approach signal along the segment of track. For example, the locomotive can receive a signal from a nearest wayside system indicating a position of the virtual approach signal along the segment of track. The locomotive can display the position of the virtual approach signal along the segment of track on a display of a PTC onboard terminal within the locomotive. The PTC onboard terminal can display a relative position of the locomotive along the segment of track and display positions of the virtual approach signals along the segment of track. The PTC onboard terminal can display the signal indicators of the virtual approach signals indicating whether the virtual approach signals are allowing travel at full speed or restricted speed. The process 500 then proceeds to step 508.

At step 508, in an embodiment, the process 500 can include the locomotive identifying the signal indication for the approach location. For example, the signal indication can include a red or flashing red indicator. When the signal indicator is the red or flashing red indicator, an electronic circuit can implement a restricting fence over the segment of track. In an example, the restricting fence can correspond to part of the segment of track based on the virtual approach signal. In an example, the virtual approach signal can indicate various statuses for the next segment of track. In an example, the virtual approach signal can include an approach indicator, a clear indicator, or a restricted indicator. The approach indicator can correspond to a reduced speed requirement along the next segment of track, until the locomotive reaches the next virtual approach signal. The clear indicator can correspond to a full speed indicator along the next segment of track, until the locomotive reaches the next virtual approach signal. The restricted indicator can correspond to a restriction in locomotive speed is in effect along the segment of track. In an example, the next segment of track can correspond to a distance between two virtual approach signals, a distance between an absolute signal and a virtual approach signal, a distance between an intermediate signal and a virtual approach signal, or any combination thereof. The process 500 then proceeds to step 510.

At step 510, in an embodiment, the process 500 can include the electronic circuit implementing the restricting fence over the segment of track. For example, the electronic circuit can implement the restricting fence by including de-energized electrical hardware. In an example, the electronic circuit can de-energize the electrical hardware in response to a railway event, including a track hazard, an occupied track, a broken rail, etc. The de-energized electronic circuit can de-energize a relay corresponding to the electronic circuit. In this way, the de-energized relay can result in a "0" in a corresponding wireless communication payload from a wayside system indicating the electronic circuit is de-energized. In an example, the de-energized electronic circuit can display on the PTC onboard terminal as a PTC yellow fence across the segment of track indicating the segment of track will not be upgraded from restricting. In an example, the electronic circuit can indicate to the virtual approach signals whether the segment of track ahead of the locomotive includes an obstacle in response to a railway event. For example, the railway event can include a track hazard, a broken rail, an occupied track, or some other type of event that can cause delay along the segment of track. In an example, the electronic circuit can be located at the approach location. The process 500 then proceeds to step 512.

At step 512, in an embodiment, the process 500 can include the electronic circuit can implement signaling measure to protect a following train from entering into an occupied section of the segment of track. For example, the electronic circuit can signal to the virtual approach signal to indicate a restriction in place such that a following locomotive does not enter the section of track. In this way, the electronic circuit can protect an open switch, broken rail, or rear of a lead train for the segment of track. The process 500 then proceeds to step 514.

At step 514, in an embodiment, the process 500 can include the electronic circuit signaling to the locomotive along the segment of track to continue adhering to the restriction condition. For example, the electronic circuit can implement a track hazard to keep the locomotive travelling at restricted speed. For example, the electronic circuit can keep the locomotive travelling at the restricted speed if the locomotive passes a flashing red indicator, red intermediate indicator, or other restricting signal indicator at an absolute until the head end of the locomotive exits the segment.

Figure 6:
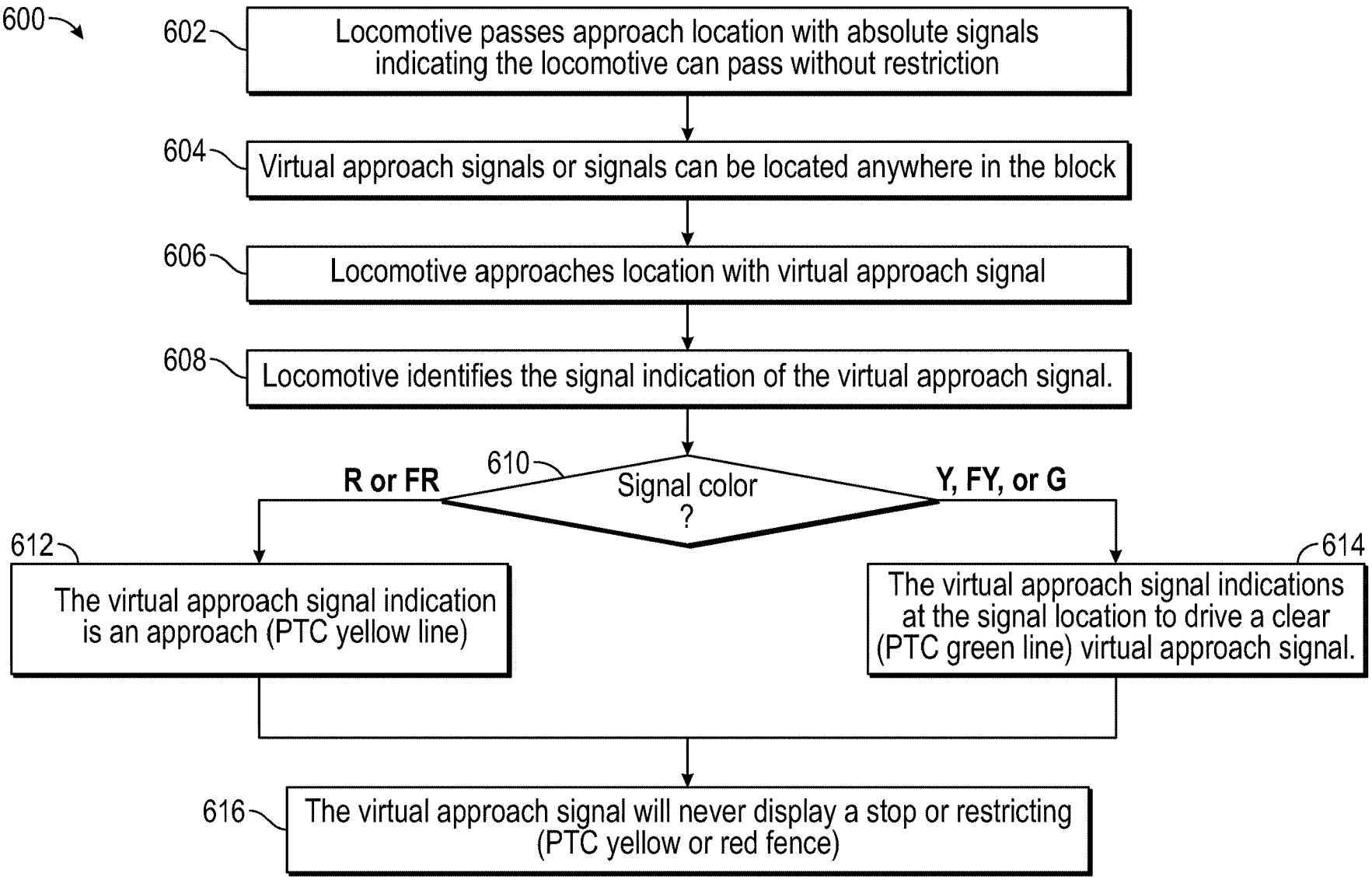
FIG. 6 illustrates a flowchart of a process for virtual approach signaling, in accordance with one or more exemplary embodiments of the present disclosure.

FIG. 6 illustrates a flowchart exemplifying a process for virtual approach signaling 600, in accordance with at least one embodiment of the present disclosure. The process for virtual approach signaling 600 can be implemented as an algorithm on a computer processor (e.g., logic controller, onboard computer, PTC onboard terminal, server, etc.), a machine learning module, or other suitable system. Additionally, the process for virtual approach signaling 600 can be achieved with software, hardware, an API, a network connection, a network transfer protocol, HTML, DHTML, JavaScript, Dojo, Ruby, Rails, other suitable applications, or a suitable combination thereof. The process for virtual approach signaling 600 implementing hardware components (e.g., computer processor) can be capable of executing machine-readable instructions to perform program steps and operably coupled to a memory having a first database with a plurality of messages, signal values, and specifications related to a vehicle and at least a portion of a track.

The process for virtual approach signaling 600 can leverage the ability of a computer platform to spawn multiple processes and threads by processing data simultaneously. The speed and efficiency of the process for virtual approach signaling 600 can be greatly improved by instantiating more than one process for responding to a track hazard. However, one skilled in the art of programming will appreciate that use of a single processing thread may also be utilized and is within the scope of the present disclosure. The process for virtual approach signaling 600 can also be distributed amongst a plurality of networked computer processors. The computer processors can be located in wayside systems or onboard the train (e.g., 110, 210, 310, etc.). The process for virtual approach signaling 600 of the present embodiment begins at step 602.

At step 602, in an embodiment, the process 600 can enable a locomotive to pass an approach location corresponding to absolute signals indicating the locomotive can pass without restriction. For example, the approach locations can include physical signal components indicating to a locomotive on a segment of track the next segment of track is clear. In an example, the physical signal components can include various colored lights either solid in color or flashing. In another example, the various colored lights can include green, yellow, or red. In an example, the restriction can include railway events resulting in an impasse along the segment of track. For example, the restriction can include a broken rail along the segment of track, or the segment of track includes another locomotive rendering the track occupied. In another example, the absolute signal can include signal indicators for which the locomotive operator can adhere. For example, the absolute signals can include signal indicators as a flashing red indicator, where the locomotive operator will stop the locomotive on the segment of track and avoid passing the approach location. The process 600 then proceeds to step 604.

At step 604, in an embodiment, the process 600 can include virtual approach signal located anywhere in a segment of track (i.e., the block). For example, the virtual approach signal can reside at any location along the segment of track. In an example, the process 600 can include a plurality of virtual approach signals located anywhere in the segment of track. In another example, when a single virtual approach signal is along the segment of track, the location of the virtual approach signal can be different for an eastbound direction of travel and a westbound direction of travel. Each direction can include defined enforcement limits. In an example, the location of the virtual approach signal is based on geolocation data. In another example, the geolocation data can include GPS data or GIS data. The location of the virtual approach signal can be based on input from a PTC coordinator, such as a railway organization. The virtual approach signal or signals can be based on an optimization metric set by the PTC coordinator. The optimization metric can be based on the use of the segment of track. For example, when the segment of track is used for passenger travels, the optimization metric can include a minimum number of virtual approach signals to adhere to stricter safety regulations. Alternatively, when the segment of track is used for cargo transportation, the optimization metric can include a maximum number of virtual approach signals to ensure rapid transit. The process 600 then proceeds to step 606.

At step 606, in an embodiment, the process 600 can include the locomotive approaching the location of the virtual approach signal along the segment of track. For example, the locomotive can receive a signal from a nearest wayside system indicating a position of the virtual approach signal along the segment of track. The locomotive can display the position of the virtual approach signal along the segment of track on a display of a PTC onboard terminal within the locomotive. The PTC onboard terminal can display a relative position of the locomotive along the segment of track and display positions of the virtual approach signals along the segment of track. The PTC onboard terminal can display the signal indicators of the virtual approach signals indicating whether the virtual approach signals are allowing travel at full speed or restricted speed. The process 600 then proceeds to step 608.

At step 608, in an embodiment, the process 600 can include the locomotive identifying the signal indication of the virtual approach signal or signals. For example, the virtual approach signal can indicate various statuses of the next segment of track. In an example, the virtual approach signal can include a first approach indicator and a second approach indicator. The first approach indicator can include a restricted speed requirement along the next segment of track, until the locomotive reaches the next virtual approach signal. The second approach indicator can include a full speed indicator along the next segment of track, until the locomotive reaches the next virtual approach signal. In an example, the next segment of track can correspond to a distance between two virtual approach signals, a distance between an absolute signal and a virtual approach signal, a distance between an intermediate signal and a virtual approach signal, or any combination thereof. The process 600 then proceeds to step 610.

At step 610, in an embodiment, the process 600 can determine what are the signal colors of the physical signaling components. The signal colors can represent a clear aspect as a green signal color. The signal colors can represent an approach aspect as yellow or flashing yellow signal colors. The signal colors can represent stop aspect as red or flashing red signal colors. In an example, the process 600 can determine whether the electronic circuit is energized or de-energized. The process 600 can determine the electronic circuit is energized based on an indicator from electrical hardware along the segment of track. For example, a signal relay indicating the electronic circuit is energized. In an example, the process 600 can determine the signal colors when the electronic circuit is energized. In another example, when the electronic circuit is de-energized, the virtual approach signals will continue to indicate a restriction for the next segment of track. If the colors include yellow, flashing yellow, or green, the process 600 then proceeds to step 614. If the colors include red or flashing red, the process 600 then proceeds to step 612.

At step 612, in an embodiment, the process 600 can include the virtual approach signal indication is an approach. In an example, the approach can include a PTC yellow line. The process 600 then proceeds to step 616.

At step 614, in an embodiment, the process 600 can include signal indications at the signal location to drive a clear virtual approach signal. In an example, the clear can include a PTC green line. The process 600 then proceeds to step 616.

At step 616, in an embodiment, the process 600 can include an event when the virtual approach signal will not display a stop or restricting indicator. For example, when the electronic circuit is energized, the virtual approach signal can include a setting where the virtual approach signal will not include a restricting indicator. In an example, the restricting indicator can include a PTC yellow fence and a PTC red fence.

Figure 7:
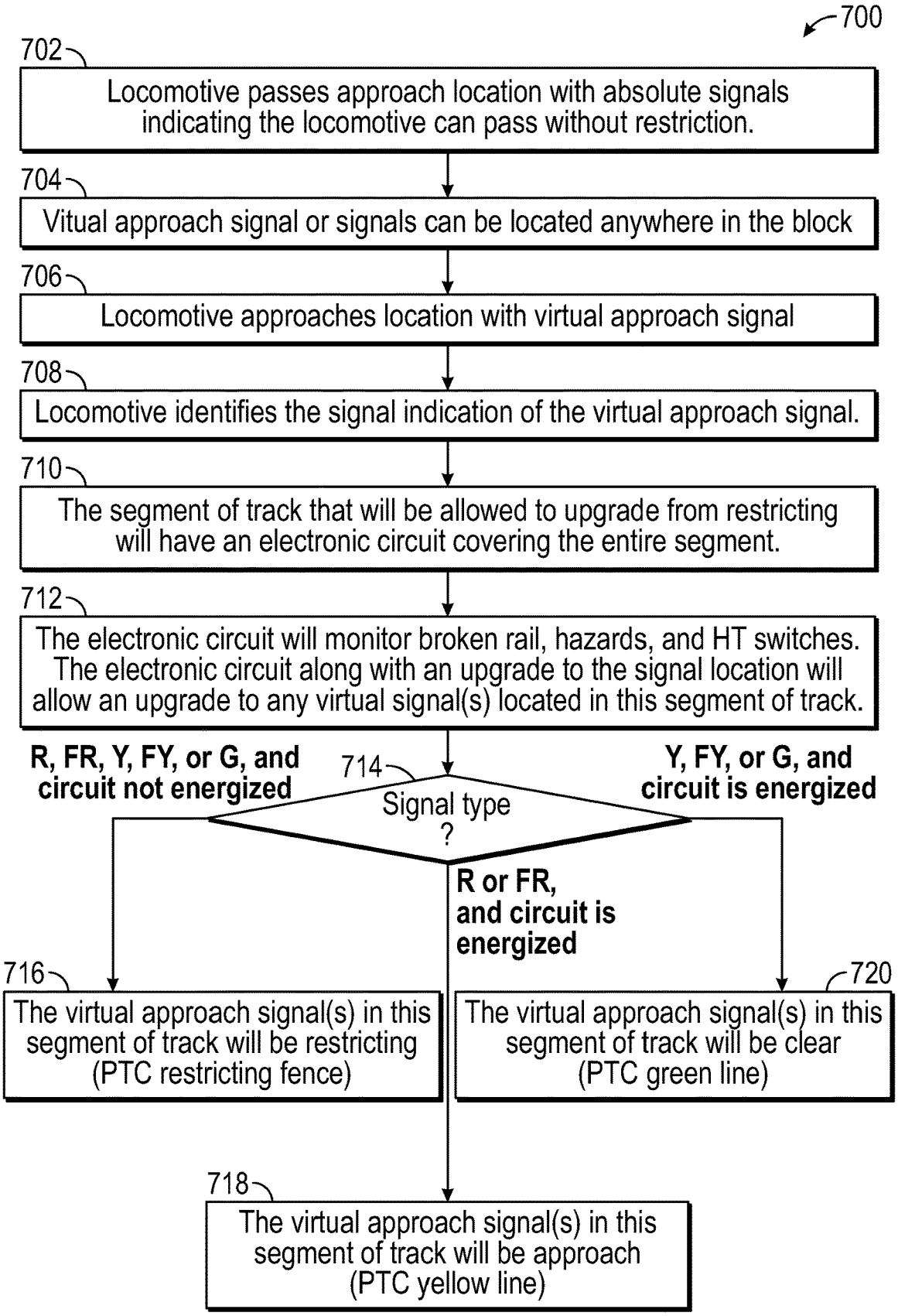
FIG. 7 illustrates a flowchart of a process for virtual approach signaling, in accordance with one or more exemplary embodiments of the present disclosure.

FIG. 7 illustrates a flowchart exemplifying a process for virtual approach signaling 700, in accordance with at least one embodiment of the present disclosure. The process for virtual approach signaling 700 can be implemented as an algorithm on a computer processor (e.g., logic controller, onboard computer, PTC onboard terminal, server, etc.), a machine learning module, or other suitable system. Additionally, the process for virtual approach signaling 700 can be achieved with software, hardware, an API, a network connection, a network transfer protocol, HTML, DHTML, JavaScript, Dojo, Ruby, Rails, other suitable applications, or a suitable combination thereof. The process for virtual approach signaling 700 implementing hardware components (e.g., computer processor) can be capable of executing machine-readable instructions to perform program steps and operably coupled to a memory having a first database with a plurality of messages, signal values, and specifications related to a vehicle and at least a portion of a track.

The process for virtual approach signaling 700 can leverage the ability of a computer platform to spawn multiple processes and threads by processing data simultaneously. The speed and efficiency of the process for virtual approach signaling 700 can be greatly improved by instantiating more than one process for responding to a track hazard. However, one skilled in the art of programming will appreciate that use of a single processing thread may also be utilized and is within the scope of the present disclosure. The process for virtual approach signaling 700 can also be distributed amongst a plurality of networked computer processors. The computer processors can be located in wayside systems or onboard the train (e.g., 110, 210, 310, etc.). The process for virtual approach signaling 700 of the present embodiment begins at step 702.

At step 702, in an embodiment, the process 700 can enable a locomotive to pass an approach location corresponding to absolute signals indicating the locomotive can pass without restriction. For example, the approach locations can include physical signal components indicating to a locomotive on a segment of track the next segment of track is clear. In an example, the physical signal components can include various colored lights either solid in color or flashing. In another example, the various colored lights can include green, yellow, or red. In an example, the restriction can include railway events resulting in an impasse along the segment of track. For example, the restriction can include a broken rail along the segment of track, or the segment of track includes another locomotive rendering the track occupied. In another example, the absolute signal can include signal indicators for which the locomotive operator can adhere. For example, the absolute signals can include signal indicators as a flashing red indicator, where the locomotive operator will stop the locomotive on the segment of track and avoid passing the approach location. The process 700 then proceeds to step 704.

At step 704, in an embodiment, the process 700 can include virtual approach signal located anywhere in a segment of track (i.e., the block). For example, the virtual approach signal can reside at any location along the segment of track. In an example, the process 700 can include a plurality of virtual approach signals located anywhere in the segment of track. In another example, when a single virtual approach signal is along the segment of track, the location of the virtual approach signal can be different for an eastbound direction of travel and a westbound direction of travel. Each direction can include defined enforcement limits. In an example, the location of the virtual approach signal is based on geolocation data. In another example, the geolocation data can include GPS data or GIS data. The location of the virtual approach signal can be based on input from a PTC coordinator, such as a railway organization. The virtual approach signal or signals can be based on an optimization metric set by the PTC coordinator. The optimization metric can be based on the use of the segment of track. For example, when the segment of track is used for passenger travels, the optimization metric can include a minimum number of virtual approach signals to adhere to stricter safety regulations. Alternatively, when the segment of track is used for cargo transportation, the optimization metric can include a maximum number of virtual approach signals to ensure rapid transit. The process 700 then proceeds to step 706.

At step 706, in an embodiment, the process 700 can include the locomotive approaching the location of the virtual approach signal along the segment of track. For example, the locomotive can receive a signal from a nearest wayside system indicating a position of the virtual approach signal along the segment of track. The locomotive can display the position of the virtual approach signal along the segment of track on a display of a PTC onboard terminal within the locomotive. The PTC onboard terminal can display a relative position of the locomotive along the segment of track and display positions of the virtual approach signals along the segment of track. The PTC onboard terminal can display the signal indicators of the virtual approach signals indicating whether the virtual approach signals are allowing travel at full speed or restricted speed. The process 700 then proceeds to step 708.

At step 708, in an embodiment, the process 700 can include the locomotive identifying the signal indication of the virtual approach signal or signals. For example, the virtual approach signal can indicate various statuses of the next segment of track. In an example, the virtual approach signal can include a first approach indicator and a second approach indicator. The first approach indicator can include a restricted speed requirement along the next segment of track, until the locomotive reaches the next virtual approach signal. The second approach indicator can include a full speed indicator along the next segment of track, until the locomotive reaches the next virtual approach signal. In an example, the next segment of track can correspond to a distance between two virtual approach signals, a distance between an absolute signal and a virtual approach signal, a distance between an intermediate signal and a virtual approach signal, or any combination thereof. The process 700 then proceeds to step 710.

At step 710, in an embodiment, the process 700 can include the segment of track that will be allowed to upgrade from restricting. For example, the segment of track can include an electronic circuit covering the entire segment. In another example, the electronic circuit can cover a part of the segment of track. The process 700 then proceeds to step 712.

At step 712, in an embodiment, the process 700 can include the electronic circuit monitoring the segment of track for any broken rails, hazards, and HT switches. The electronic circuit along with an upgrade to the signal location will allow an upgrade to any virtual signal located in this segment of track. The process 700 then proceeds to step 714.

At step 714, in an embodiment, the process 700 can determine what are the signal colors of the physical signaling components. The signal colors can represent a clear aspect as a green signal color. The signal colors can represent an approach aspect as yellow or flashing yellow signal colors. The signal colors can represent stop aspect as red or flashing red signal colors. In an example, the process 700 can determine whether the electronic circuit is energized or de-energized. The process 700 can determine the electronic circuit is energized based on an indicator from electrical hardware along the segment of track. For example, a signal relay indicating the electronic circuit is energized. In an example, the process 700 can determine the signal colors when the electronic circuit is energized. In another example, when the electronic circuit is de-energized, the virtual approach signals will continue to indicate a restriction for the next segment of track. If the colors include red, flashing red, yellow, flashing yellow, or green, and the circuit is not energized, the process 700 then proceeds to step 716. If the colors include red or flashing red, and the circuit is energized, the process 700 then proceeds to step 718. If the colors include yellow, flashing yellow, or green, and the circuit is energized, the process 700 then proceeds to step 720.

At step 716, in an embodiment, the process 700 can include the virtual approach signal in the segment of track can include a restricting indicator. For example, the restricting indicator can include a PTC restricting fence. In an example, the PTC restricting fence can include a yellow PTC restricting fence and a red PTC restricting fence. The yellow PTC restricting fence can indicate a restricted speed in the next segment of track. The red PTC restricting fence can indicate for the locomotive to stop altogether.

At step 718, in an embodiment, the process 700 can include the virtual approach signal indication signaling an approach aspect. For example, the approach aspect can include a PTC yellow line. In another example, the approach aspect can include a PTC restriction fence indicating a restricted speed.

At step 720, in an embodiment, the process 700 include signal indications at the signal location to drive a clear virtual approach signal. For example, the clear can include a PTC green line. In an example, the PTC green line can indicate the locomotive can travel along the segment of track at full speed.

Figure 8:
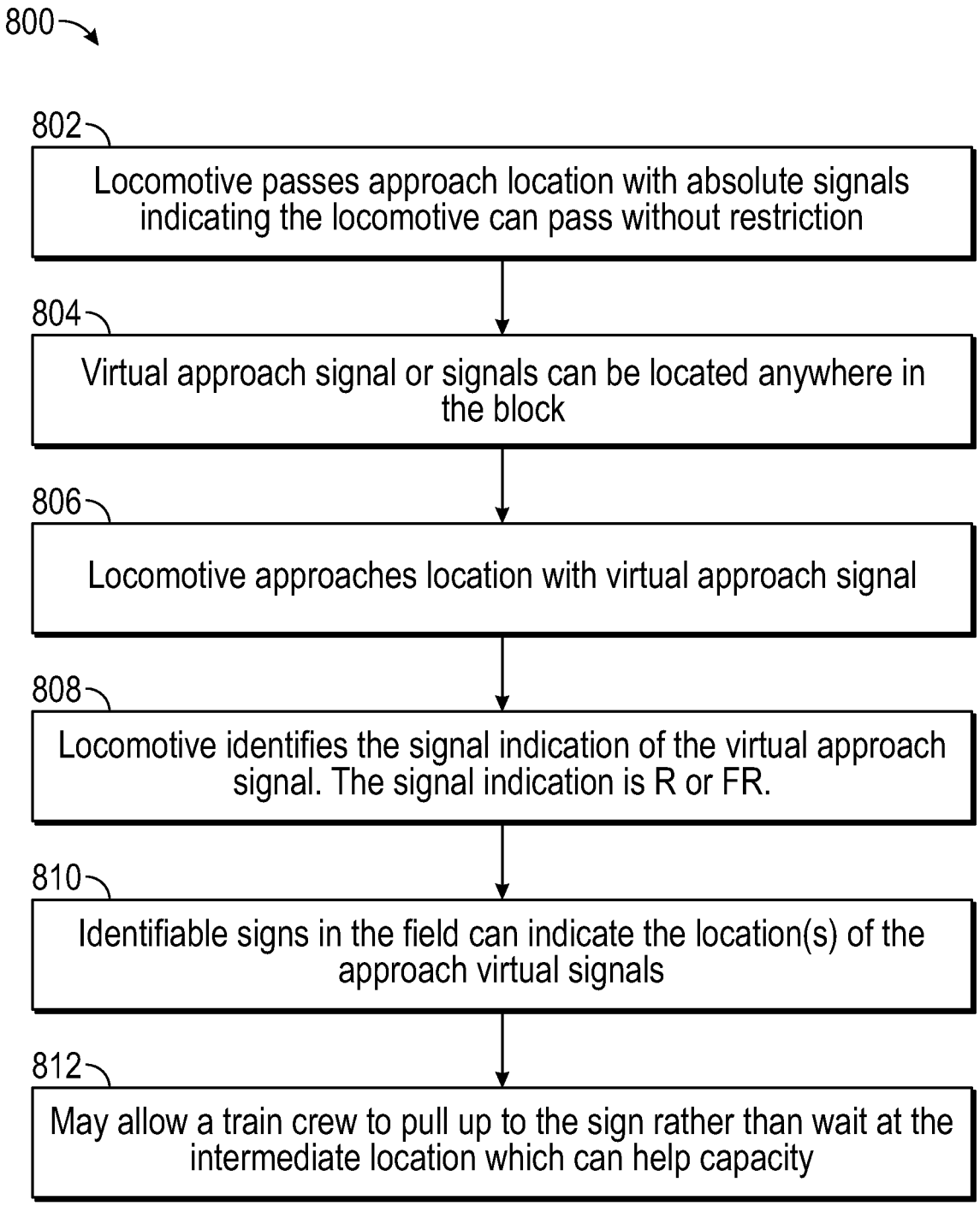
FIG. 8 illustrates a flowchart of a process for virtual approach signaling, in accordance with one or more exemplary embodiments of the present disclosure.

FIG. 8 illustrates a flowchart exemplifying a process for virtual approach signaling 800, in accordance with at least one embodiment of the present disclosure. The process for virtual approach signaling 800 can be implemented as an algorithm on a computer processor (e.g., logic controller, onboard computer, PTC onboard terminal, server, etc.), a machine learning module, or other suitable system. Additionally, the process for virtual approach signaling 800 can be achieved with software, hardware, an API, a network connection, a network transfer protocol, HTML, DHTML, JavaScript, Dojo, Ruby, Rails, other suitable applications, or a suitable combination thereof. The process for virtual approach signaling 800 implementing hardware components (e.g., computer processor) can be capable of executing machine-readable instructions to perform program steps and operably coupled to a memory having a first database with a plurality of messages, signal values, and specifications related to a vehicle and at least a portion of a track.

The process for virtual approach signaling 800 can leverage the ability of a computer platform to spawn multiple processes and threads by processing data simultaneously. The speed and efficiency of the process for virtual approach signaling 800 can be greatly improved by instantiating more than one process for responding to a track hazard. However, one skilled in the art of programming will appreciate that use of a single processing thread may also be utilized and is within the scope of the present disclosure. The process for virtual approach signaling 800 can also be distributed amongst a plurality of networked computer processors. The computer processors can be located in wayside systems or onboard the train (e.g., 110, 210, 310, etc.). The process for virtual approach signaling 800 of the present embodiment begins at step 802.

At step 802, in an embodiment, the process 800 can enable a locomotive to pass an approach location corresponding to absolute signals indicating the locomotive can pass without restriction. For example, the approach locations can include physical signal components indicating to a locomotive on a segment of track the next segment of track is clear. In an example, the physical signal components can include various colored lights either solid in color or flashing. In another example, the various colored lights can include green, yellow, or red. In an example, the restriction can include railway events resulting in an impasse along the segment of track. For example, the restriction can include a broken rail along the segment of track, or the segment of track includes another locomotive rendering the track occupied. In another example, the absolute signal can include signal indicators for which the locomotive operator can adhere. For example, the absolute signals can include signal indicators as a flashing red indicator, where the locomotive operator will stop the locomotive on the segment of track and avoid passing the approach location. The process 800 then proceeds to step 804.

At step 804, in an embodiment, the process 800 can include virtual approach signal located anywhere in a segment of track (i.e., the block). For example, the virtual approach signal can reside at any location along the segment of track. In an example, the process 800 can include a plurality of virtual approach signals located anywhere in the segment of track. In another example, when a single virtual approach signal is along the segment of track, the location of the virtual approach signal can be different for an eastbound direction of travel and a westbound direction of travel. Each direction can include defined enforcement limits. In an example, the location of the virtual approach signal is based on geolocation data. In another example, the geolocation data can include GPS data or GIS data. The location of the virtual approach signal can be based on input from a PTC coordinator, such as a railway organization. The virtual approach signal or signals can be based on an optimization metric set by the PTC coordinator. The optimization metric can be based on the use of the segment of track. For example, when the segment of track is used for passenger travels, the optimization metric can include a minimum number of virtual approach signals to adhere to stricter safety regulations. Alternatively, when the segment of track is used for cargo transportation, the optimization metric can include a maximum number of virtual approach signals to ensure rapid transit. The process 800 then proceeds to step 806.

At step 806, in an embodiment, the process 800 can include the locomotive approaching the location of the virtual approach signal along the segment of track. For example, the locomotive can receive a signal from a nearest wayside system indicating a position of the virtual approach signal along the segment of track. The locomotive can display the position of the virtual approach signal along the segment of track on a display of a PTC onboard terminal within the locomotive. The PTC onboard terminal can display a relative position of the locomotive along the segment of track and display positions of the virtual approach signals along the segment of track. The PTC onboard terminal can display the signal indicators of the virtual approach signals indicating whether the virtual approach signals are allowing travel at full speed or restricted speed. The process 800 then proceeds to step 808.

At step 808, in an embodiment, the process 800 can include the locomotive identifying the signal indication of the virtual approach signal or signals. For example, the virtual approach signal can indicate various statuses of the next segment of track. In an example, the virtual approach signal can include a first approach indicator and a second approach indicator. The first approach indicator can include a restricted speed requirement along the next segment of track, until the locomotive reaches the next virtual approach signal. The second approach indicator can include a full speed indicator along the next segment of track, until the locomotive reaches the next virtual approach signal. In an example, the next segment of track can correspond to a distance between two virtual approach signals, a distance between an absolute signal and a virtual approach signal, a distance between an intermediate signal and a virtual approach signal, or any combination thereof. The process 800 then proceeds to step 810.

At step 810, in an embodiment, the process 800 can include identifiable signs in the field can indicate the location or locations of the virtual approach signals. For example, the segment of track can include the signs. In an example, the signs can include hardware components storing geolocation data to identify the location along the segment of track. The geolocation data can include GPS data, GIS data, milepost data, latitude-longitude coordinates, or any other identifiable geolocation data. The process 800 then proceeds to step 812.

At step 812, in an embodiment, the process 800 can include a crew arriving to the sign rather than wait at an intermediate location.

Figure 9:
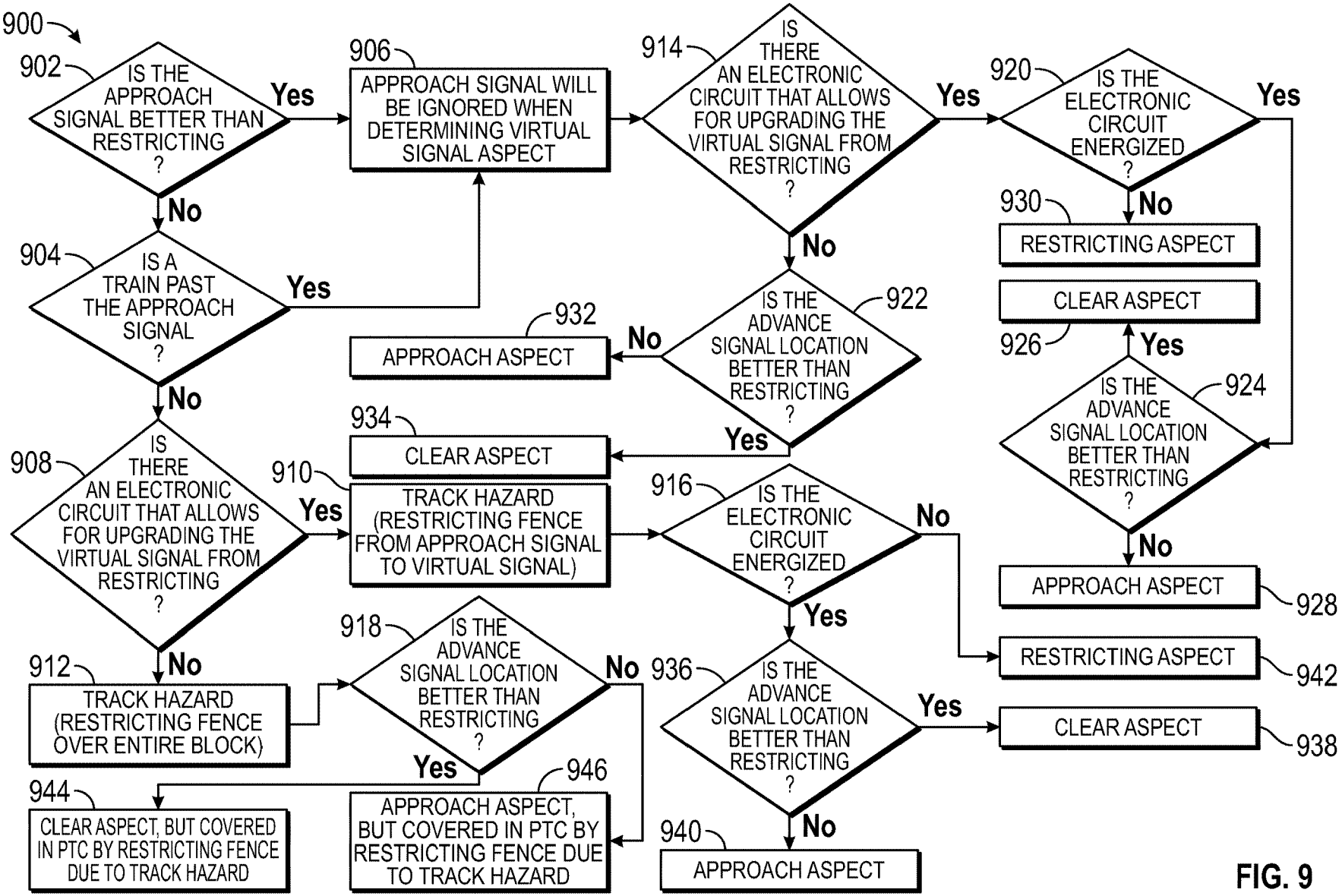
FIG. 9 illustrates a flowchart of a process for virtual approach signaling, in accordance with one or more exemplary embodiments of the present disclosure.

FIG. 9 illustrates a flowchart exemplifying a process for virtual approach signaling 900, in accordance with at least one embodiment of the present disclosure. The process for virtual approach signaling 900 can be implemented as an algorithm on a computer processor (e.g., logic controller, onboard computer, PTC onboard terminal, server, etc.), a machine learning module, or other suitable system. Additionally, the process for virtual approach signaling 900 can be achieved with software, firmware, hardware, an API, a network connection, a network transfer protocol, HTML, DHTML, JavaScript, Dojo, Ruby, Rails, other suitable applications, or a suitable combination thereof. The process for virtual approach signaling 900 (e.g., computer processor) can be capable of executing machine-readable instructions to perform program steps and operably coupled to a memory having a first database with a plurality of messages, signal values, and specifications related to a vehicle and at least a portion of a track.

The process for virtual approach signaling 900 can leverage the ability of a computer platform to spawn multiple processes and threads by processing data simultaneously. The speed and efficiency of the process for virtual approach signaling 900 can be greatly improved by instantiating more than one process to implement a virtual approach signaling. However, one skilled in the art of programming will appreciate that use of a single processing thread may also be utilized and is within the scope of the present disclosure. The virtual approach signaling control logic 900 can also be distributed amongst a plurality of networked computer processors. The computer processors can be located in a wayside system or onboard a locomotive. The process for virtual approach signaling 900 flow of the present embodiment begins at step 902.

At step 902, in an embodiment, the process 900 can determine whether the approach signal is less restrictive than a restricting signal. For example, the approach signal can be less restrictive than the restricting signal when the approach signal indicates an approach aspect or a clear aspect. In another example, when the restricting signal indicates a PTC yellow restricting fence, the approach signal is less restrictive when the approach signal is the clear aspect. In another example, when the restricting signal indicates a PTC red restricting fence, the approach signal is less restrictive when the approach signal is the approach aspect or the clear aspect. If the approach signal is more restrictive than a restricting signal, then the process 900 proceeds to step 904. If the approach signal is less restrictive than the restricting signal, then the process 900 then proceeds to step 906.

At step 904, in an embodiment, the process 900 can determine whether the locomotive is past the approach signal. For example, a front end of the locomotive can physically be past a position of the approach signal along the segment of track. If the locomotive is past the approach signal, then the process 900 proceeds to step 906. If the locomotive is not past the approach signal, then the process 900 proceeds to step 908.

At step 906, in an embodiment, the process 900 can include an operator of the locomotive ignoring the approach signal when determining a virtual approach signal. In an example, the locomotive can travel along a segment of track past the approach signal. The locomotive can be under human operator control without mechanical safeguards to prevent any locomotives from traveling along the segment of track, thereby allowing the locomotive to pass the approach signal from manual operator override. The process 900 then proceeds to step 914.

At step 908, in an embodiment, the process 900 can determine whether there is an electronic circuit that allows for upgrading the virtual approach signal from restricting. For example, the locomotive can receive a communication signal indicating a railway electrical architecture including a variable corresponding to whether the segment of track includes the electronic circuit. In an example, the communication signal can include a payload with various bits corresponding to physical hardware. The payload can include bit flags indicating whether the railway includes electrical hardware. For example, when the payload includes a bit indicating whether the railway includes the electronic circuit, the bit can be a "0" when the railway lacks the electronic circuit or a "1" when the railway includes the electronic circuit. If the there is an electronic circuit, the process 900 proceeds to step 910. If there is no electronic circuit, the process 900 then proceeds to step 912.

At step 910, in an embodiment, the process 900 can include a track hazard. For example, the track hazard can include a restricting fence from the approach signal to the virtual approach signal. In an example, the restricting fence can include a PTC yellow restricting fence indicating a restricted speed across the segment of track. In another example, the restricting fence can include a PTC red restricting fence indicating for the locomotive to stop altogether. The process 900 then proceeds to step 916.

At step 912, in an embodiment, the process 900 can include a track hazard. For example, the track hazard can include a restricting fence over the entire segment of track. In an example, the restricting fence can include a PTC yellow restricting fence indicating a restricted speed across the segment of track. In another example, the restricting fence can include a PTC red restricting fence indicating for the locomotive to stop altogether. The process 900 then proceeds to step 918.

At step 914, in an embodiment, the process 900 can determine whether there is an electronic circuit that allows for upgrading the virtual approach signal from restricting. For example, the locomotive can receive a communication signal indicating a railway electrical architecture including a variable corresponding to whether the segment of track includes the electronic circuit. In an example, the communication signal can include a payload with various bits corresponding to physical hardware. The payload can include bit flags indicating whether the railway includes electrical hardware. For example, when the payload includes a bit indicating whether the railway includes the electronic circuit, the bit can be a "0" when the railway lacks the electronic circuit or a "1" when the railway includes the electronic circuit. If the there is an electronic circuit, the process 900 proceeds to step 920. If there is no electronic circuit, the process 900 then proceeds to step 922.

At step 916, in an embodiment, the process 900 can determine whether the electronic circuit is energized. For example, the electronic circuit can include a signal relay holding an electrical charge when the electronic circuit is energized. In an example, the signal relay can indicate to the locomotive whether the electronic circuit is energized. In another example, the signal relay can indicate to the wayside system whether the electronic circuit is energized. If the electronic circuit is energized, the process 900 then proceeds to step 936. If the electronic circuit is not energized, the process 900 then proceeds to step 942.

At step 918, in an embodiment, the process 900 can determine whether the advance signal location is less restrictive than a restricting signal. For example, the advance signal can be less restrictive than the restricting signal when the advance signal indicates an approach aspect or a clear aspect. In another example, when the restricting signal indicates a PTC yellow restricting fence, the advance signal is less restrictive when the approach signal is the clear aspect. In another example, when the restricting signal indicates a PTC red restricting fence, the advance signal is less restrictive when the approach signal is the approach aspect or the clear aspect. If the advance signal is less restrictive than the restricting signal, the process 900 then proceeds to step 944. If the advance signal is more restrictive than the restricting signal, the process 900 then proceeds to step 946.

At step 920, in an embodiment, the process 900 can determine whether the electronic circuit is energized. For example, the electronic circuit can include a signal relay holding an electrical charge when the electronic circuit is energized. In an example, the signal relay can indicate to the locomotive whether the electronic circuit is energized. In another example, the signal relay can indicate to the wayside system whether the electronic circuit is energized. If the electronic circuit is energized, the process 900 then proceeds to step 924. If the electronic circuit is not energized, the process 900 then proceeds to step 930.

At step 922, in an embodiment, the process 900 can determine whether the advance signal location is less restrictive than a restricting signal. For example, the advance signal can be less restrictive than the restricting signal when the advance signal indicates an approach aspect or a clear aspect. In another example, when the restricting signal indicates a PTC yellow restricting fence, the advance signal is less restrictive when the approach signal is the clear aspect. In another example, when the restricting signal indicates a PTC red restricting fence, the advance signal is less restrictive when the approach signal is the approach aspect or the clear aspect. If the advance signal is less restrictive than the restricting signal, the process 900 then proceeds to step 932. If the advance signal is more restrictive than the restricting signal, the process 900 then proceeds to step 934.

At step 924, in an embodiment, the process 900 can determine whether the advance signal location is less restrictive than a restricting signal. For example, the advance signal can be less restrictive than the restricting signal when the advance signal indicates an approach aspect or a clear aspect. In another example, when the restricting signal indicates a PTC yellow restricting fence, the advance signal is less restrictive when the approach signal is the clear aspect. In another example, when the restricting signal indicates a PTC red restricting fence, the advance signal is less restrictive when the approach signal is the approach aspect or the clear aspect. If the advance signal is less restrictive than the restricting signal, the process 900 then proceeds to step 926. If the advance signal is more restrictive than the restricting signal, the process 900 then proceeds to step 928.

At step 926, in an embodiment, the process 900 can signal the segment of track is a clear aspect. For example, the clear can include a PTC green line. In an example, the PTC green line can indicate the locomotive can travel along the segment of track at full speed.

At step 928, in an embodiment, the process 900 can signal the segment of track is an approach aspect. For example, the approach aspect can include a PTC yellow line. In another example, the approach aspect can include a PTC restriction fence indicating a restricted speed.

At step 930, in an embodiment, the process 900 can signal the segment of track is a restricting aspect. For example, the restricting aspect can include a PTC yellow restricting fence or a PTC red restricting fence. In an example, the restricting fence can include a PTC yellow restricting fence indicating a restricted speed across the segment of track. In another example, the restricting fence can include a PTC red restricting fence indicating for the locomotive to stop altogether.

At step 932, in an embodiment, the process 900 can signal the segment of track is a clear aspect. For example, the clear can include a PTC green line. In an example, the PTC green line can indicate the locomotive can travel along the segment of track at full speed.

At step 934, in an embodiment, the process 900 can signal the segment of track is an approach aspect. For example, the approach aspect can include a PTC yellow line. In another example, the approach aspect can include a PTC restriction fence indicating a restricted speed.

At step 936, in an embodiment, the process 900 can determine whether the advance signal location is less restrictive than a restricting signal. For example, the advance signal can be less restrictive than the restricting signal when the advance signal indicates an approach aspect or a clear aspect. In another example, when the restricting signal indicates a PTC yellow restricting fence, the advance signal is less restrictive when the approach signal is the clear aspect. In another example, when the restricting signal indicates a PTC red restricting fence, the advance signal is less restrictive when the approach signal is the approach aspect or the clear aspect. If the advance signal is less restrictive than the restricting signal, the process 900 then proceeds to step 938. If the advance signal is more restrictive than the restricting signal, the process 900 then proceeds to step 940.

At step 938, in an embodiment, the process 900 can signal the segment of track is a clear aspect. For example, the clear can include a PTC green line. In an example, the PTC green line can indicate the locomotive can travel along the segment of track at full speed.

At step 940, in an embodiment, the process 900 can signal the segment of track is an approach aspect. For example, the clear can include a PTC green line. In an example, the PTC green line can indicate the locomotive can travel along the segment of track at full speed.

At step 942, in an embodiment, the process 900 can signal the segment of track is a restricting aspect. For example, the restricting aspect can include a PTC yellow restricting fence or a PTC red restricting fence. In an example, the restricting fence can include a PTC yellow restricting fence indicating a restricted speed across the segment of track. In another example, the restricting fence can include a PTC red restricting fence indicating for the locomotive to stop altogether.

At step 944, in an embodiment, the process 900 can signal the segment of track is a clear aspect, but covered in PTC by restricting fence due to track hazard. For example, the clear can include a PTC green line. In an example, the PTC green line can indicate the locomotive can travel along the segment of track at full speed, but the restricting fence limits the speed, so the locomotive can travel at a restricted speed.

At step 946, in an embodiment, the process 900 can signal the segment of track is a restricting aspect, but covered in PTC by restricting fence due to track hazard. For example, the restricting aspect can include a PTC yellow restricting fence or a PTC red restricting fence. In an example, the restricting fence can include a PTC yellow restricting fence indicating a restricted speed across the segment of track. In another example, the restricting fence can include a PTC red restricting fence indicating for the locomotive to stop altogether.

Figure 10A:
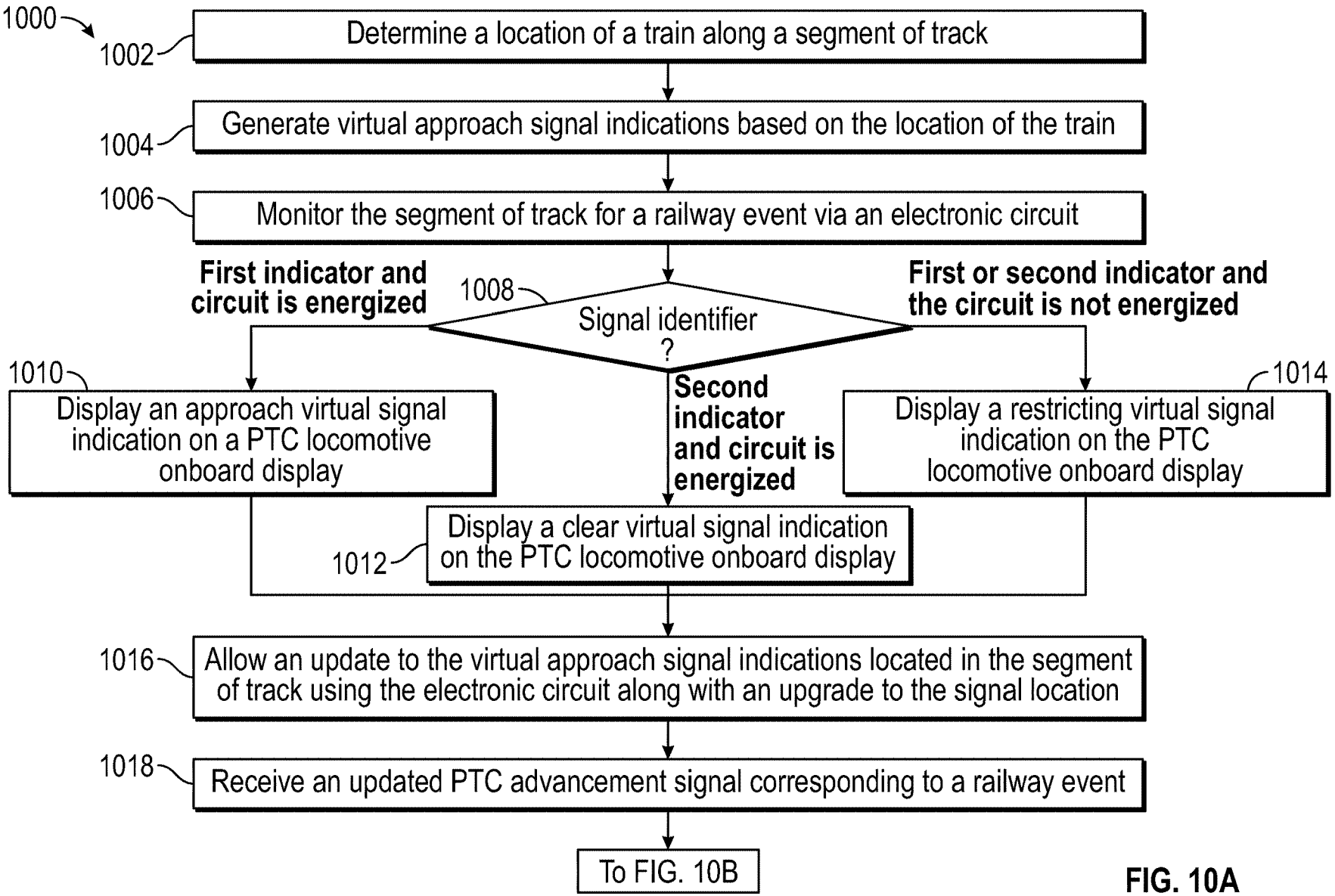
FIGS. 10A and 10B illustrate a flowchart for virtual approach signaling control logic, in accordance with one or more exemplary embodiments of the present disclosure.
Figure 10B:
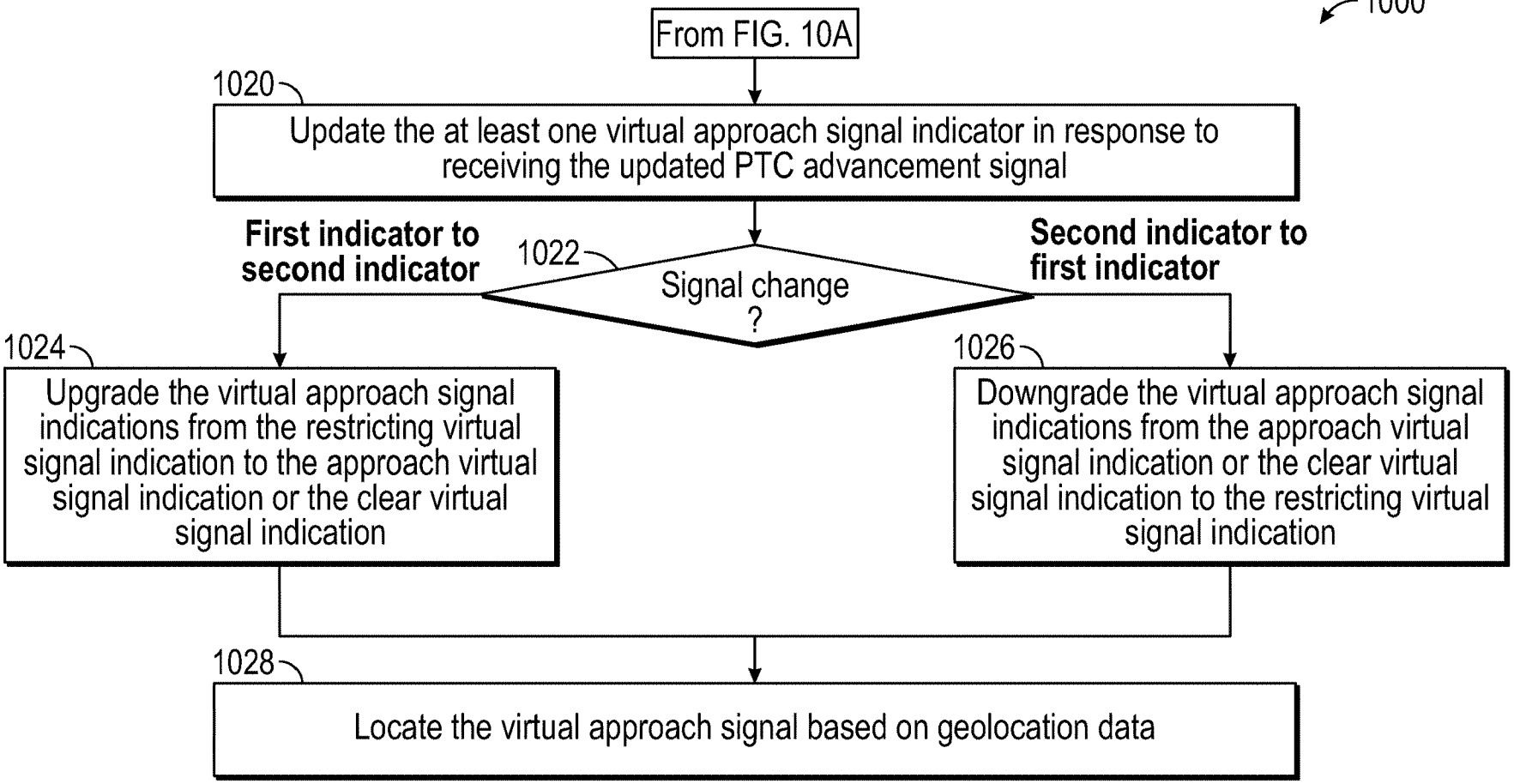

FIGS. 10A and 10B illustrate a flowchart exemplifying virtual approach signaling control logic 1000, in accordance with one or more exemplary embodiments of the present disclosure. The virtual approach signaling control logic 1000 can be implemented as an algorithm on a computer processor (e.g., a wayside system including a PTC onboard computer, wayside system including a PTC onboard computer and a processor, an onboard computer, a server, etc.), a machine learning module, or other suitable system. Additionally, the virtual approach signaling control logic 1000 can be achieved with software, firmware, hardware, an API, a network connection, a network transfer protocol, HTML, DHTML, JavaScript, Dojo, Ruby, Rails, other suitable applications, or a suitable combination thereof. The virtual approach signaling control logic 1000 (e.g., computer processor) can be capable of executing machine-readable instructions to perform program steps and operably coupled to a memory having a first database with a plurality of messages, signal values, and specifications related to a vehicle and at least a portion of a track.

The virtual approach signaling control logic 1000 can leverage the ability of a computer platform to spawn multiple processes and threads by processing data simultaneously. In an embodiment, the virtual approach signaling control logic 1000 can be implemented using a wayside system including a PTC onboard computer and processor. For example, the wayside system can communicate the signaling aspects of the absolute, intermediate, and virtual approach signals to the locomotives along the segment of track. In an example, the PTC onboard computer and the processor of the wayside system can execute instructions to perform the virtual approach signaling control logic 1000. The wayside system can transmit communication signals using the PTC onboard computer and the processor. The speed and efficiency of the virtual approach signaling control logic 1000 can be greatly improved by instantiating more than one process to implement a virtual approach signaling. However, one skilled in the art of programming will appreciate that use of a single processing thread may also be utilized and is within the scope of the present disclosure. The virtual approach signaling control logic 1000 can also be distributed amongst a plurality of networked computer processors. The computer processors can be located in a wayside system or onboard a locomotive. The virtual approach signaling control logic 1000 process flow of the present embodiment begins at step 1002.

At step 1002, in an embodiment, the control logic 1000 can determine a location of a train along a segment of track. For example, the control logic 1000 can determine the location along the segment of track based on geolocation data. In an example, the control logic 1000 can receive GPS data and compare the GPS data to known geolocation positions of milepost markers along the segment of track. In another example, the control logic 1000 can receive a wireless communication signal from a wayside system including the geolocation positions of the milepost markers. In another example, the control logic 1000 can display the milepost markers on the PTC onboard terminal corresponding to the location of the train.

In another example, the control logic 1000 can receive a PTC advancement signal from a CTC system indicating a signal identifier of a signal location. For example, the PTC advancement signal can include a wireless communication signal such as an electromagnetic signal transmitted over-the-air. In another example, the CTC system can control locomotive traffic along the segment of track. In another example, the control logic 1000 can receive the PTC advancement signal using wireless communication hardware of the locomotive. For example, the control logic 1000 can control the wireless communication hardware to receive the PTC advancement signal and convert the PTC advancement signal into digital format. In another example, the signal location can include physical hardware used to provide physical signaling components such as lighting elements, electronic circuitry, audio circuitry, or other types of physical signaling components. For example, the signal location can include an absolute signal or an intermediate signal. In another example, the locomotive can receive the PTC advancement signal using a PTC onboard terminal. The control logic 1000 then proceeds to step 1004.

At step 1004, in an embodiment, the control logic 1000 can generate virtual approach signal indications based on the location of the train. In another example, the control logic 1000 can receive a PTC advancement signal from a CTC system indicating a signal identifier of a signal location. For example, the PTC advancement signal can include a wireless communication signal such as an electromagnetic signal transmitted over-the-air. In another example, the CTC system can control locomotive traffic along the segment of track. In another example, the control logic 1000 can receive the PTC advancement signal using wireless communication hardware of the locomotive. For example, the control logic 1000 can control the wireless communication hardware to receive the PTC advancement signal and convert the PTC advancement signal into digital format. In another example, the signal location can include physical hardware used to provide physical signaling components such as lighting elements, electronic circuitry, audio circuitry, or other types of physical signaling components. For example, the signal location can include an absolute signal or an intermediate signal. In another example, the locomotive can receive the PTC advancement signal using a PTC onboard terminal. The control logic 1000 can search the information for an identifiable variable indicating a type of advancement indicator from the PTC advancement signal. In another example, the first advancement indicator can include a red signal indicator or a flashing red signal indicator. In another example, the second advancement indicator can include a yellow signal indicator, a flashing yellow signal indicator, or a green signal indicator. The control logic 1000 then proceeds to step 1006.

At step 1006, in an embodiment, the control logic 1000 can monitor the segment of track for a railway event via an electronic circuit. In an example, the electronic circuit can determine whether the railway event results in an occupied track. The electronic circuit can energize electrical hardware to indicate to the locomotive the restricting aspect is clear. In an example, the electronic circuit can apply power to each rail and a relay coil wired across them. When no train is present along the track, a relay is energized by the current flowing from the power source through the rails. When a train is present along the track, its axles short (shunt) the rails together and the current to the track relay coil drops, and it is de-energized. In an example, the electronic circuit, through the relay contacts can report whether or not the track is occupied. The electronic circuit can detect a defined section of track, such as a block. In an example, the sections of track are separated by insulated joints, usually in both rails. In another example, the electronic circuit can include electrical power at low voltages (1.5 to 12 volts-direct current). In another example, the relays and the power supply are attached to opposite ends of the section to prevent broken rails from electrically isolating part of the track from the circuit. A series resistor limits the current when the track circuit is short-circuited. the electronic circuit can generate and transmit the electronic circuit signal. In another example, the electronic circuit can include an audio frequency circuit. The control logic 1000 then proceeds to step 1008.

At step 1008, in an embodiment, the control logic 1000 can determine a signal identifier based on the information from the PTC advancement signal. For example, the control logic 1000 can parse the information of the PTC advancement signal to identify a variable of the information as the advancement indicator and store the variable locally. The PTC advancement signal can correspond with an indicator from the physical signaling components indicating whether a locomotive can safely travel along the segment of track. If the signal identifier is the first signal indicator, the control logic 1000 then proceeds to step 1008. If the signal identifier is the second signal indicator, the control logic 1000 then proceeds to step 1010.

At step 1010, in an embodiment, the control logic 1000 can display an approach virtual signal indication on a PTC locomotive onboard display. For example, the virtual approach signal indicator can include digitally generated indicators to display on the PTC onboard terminal. For example, the PTC onboard terminal can include a digital representation of the segment of track including the various absolute signals and intermediate signals. The PTC onboard terminal can include the virtual approach signal indicator as a signaling component between physical signaling components. The virtual approach signal indicator can indicate signal identifiers corresponding to the signal location. For example, if the signal location includes a red signal indicator or flashing red signal indicator, the virtual approach signal indicator can include a yellow signal indicator. The yellow signal indicator can communicate to the operator the locomotive is to reduce speed in the next segment of track. Alternatively, if the signal location includes a yellow signal indicator, flashing yellow signal indicator, or green signal indicator, the virtual approach signal indicator can include a green signal indicator. The green signal indicator can communicate to the operator the locomotive can travel at full speed in the next segment of track. In another example, the segment of track can include a plurality of virtual approach signals. For example, the segment of track can include as many virtual approach signals applicable for safety requirements.

In another example, the segment of track can include the virtual approach signal indicator at a particular location along the segment of track. The particular location can correspond to GPS data, GIS data, latitude-longitude data, milepost data, or any other type of geolocation data relevant to the virtual approach signal indicator. In another example, the first locomotive approach type is a reduced-speed indicator. In another example, the virtual approach signal indicator corresponds to a mapping file. The mapping file can associate the at least one virtual approach signal indicators to a position along the segment of track. The mapping file can interface a PTC onboard terminal with the CTC system to display information corresponding to the virtual approach signal indicators. For example, the mapping file can include location information about the virtual approach signal indicators such that the PTC onboard terminal can identify a location of the virtual approach signal indicators relative to the locomotive along the segment of track. In another example, the mapping file can include information regarding a number of virtual approach signal indicators along the segment of track. The mapping file can adapt the number of virtual approach signal indicators depending on a use of the segment of track. For example, the mapping file can include information to increase a frequency of locomotives along the segment of track when the locomotives are transporting cargo. The control logic 1000 then proceeds to step 1016.

At step 1012, in an embodiment, the control logic 1000 can display a clear virtual signal indication on a PTC locomotive onboard display. For example, the second locomotive approach type is a full-speed indicator. In an example, the full-speed indicator can correspond to a maximum sustainable velocity of the locomotive within any regulatory limits. In another example, the virtual approach signal indicator corresponds to a mapping file. For example, the second locomotive approach type is an open track indicator. The control logic 1000 then proceeds to step 1016.

At step 1014, in an embodiment, the control logic 1000 can display a restricting virtual signal indication on a PTC locomotive onboard display. In an example, the restriction in speed can be represented as a restricting fence along the segment of track. For example, the PTC onboard terminal can display the segment of track without an ability to upgrade. In an example, the restricting fence can correspond to part of the segment of track based on the virtual approach signal. In an example, the virtual approach signal can indicate various statuses for the next segment of track. The restricting fence can correspond to a restriction in locomotive speed is in effect along the segment of track. The control logic 1000 then proceeds to step 1016.

At step 1016, in an embodiment, the control logic 1000 can allow an update to the virtual approach signal indications located in the segment of track using the electronic circuit along with an upgrade to the signal location. For example, the electronic circuit can control the update to the virtual approach signal indications based on a status of the segment of track. In an example, the electronic circuit can upgrade the restricting fence over the segment of track. For example, the electronic circuit can implement the restricting fence by de-energizing electrical hardware. In an example, the electronic circuit can de-energize the electrical hardware in response to a railway event, including a track hazard, an occupied track, a broken rail, etc. The de-energized electronic circuit can de-energize a relay corresponding to the electronic circuit. In this way, the de-energized relay can result in a "0" in a corresponding wireless communication payload from a wayside system indicating the electronic circuit is de-energized. In an example, the de-energized electronic circuit can display on the PTC onboard terminal as a PTC yellow fence across the segment of track indicating the segment of track will not be upgraded from restricting. The electronic circuit can upgrade the restricting to remove any restriction on speed for the locomotive. For example, when the segment of track is clear, the electronic circuit can energize the electrical hardware, indicating a "1" in the communication payload. The energized hardware can indicate to the locomotive the segment of track is clear and to disregard the restriction. The control logic 1000 then proceeds to step 1018.

At step 1018, in an embodiment, the control logic 1000 can receive an updated PTC advancement signal corresponding to a railway event. For example, the railway event can include a broken rail, an occupied track, an unoccupied track, or a HT switch. The updated PTC advancement signal can include information indicating whether the railway event is present in the segment of track. For example, the railway event can occur along the segment of track triggering the physical signaling component to generate a caution signal and transmit to a CTC system. In response, the CTC system can transmit the updated PTC advancement signal to the locomotive. The control logic 1000 then proceeds to step 1020.

At step 1020, in an embodiment, the control logic 1000 can update the at least one virtual approach signal indicator in response to receiving the updated PTC advancement signal. For example, the control logic 1000 can receive the updated PTC advancement signal using the wireless communication hardware of the locomotive. In response to receiving the updated PTC advancement signal, the control logic 1000 can update the display of the PTC onboard terminal to indicate positions and statuses of the virtual approach signal indicators relative to the locomotive. The control logic 1000 then proceeds to step 1022.

At step 1022, in an embodiment, the control logic 1000 can determine a signal change. For example, the control logic 1000 can parse the updated PTC advancement signal for digital formatted machine-readable information to determine whether the advancement indicator changed from one state to another. In an example, a railway event can result in the CTC system updating the PTC advancement signal from the first advancement indicator to the second advancement indicator when the railway event causes an obstruction on the segment of track. If the signal change is from the first indicator to the second indicator, the control logic 1000 then proceeds to step 1024. If the signal change is from the second indicator to the first indicator, the control logic 1000 then proceeds to step 1026.

At step 1024, in an embodiment, the control logic 1000 can upgrade the at least one virtual approach signal indicator from the first locomotive approach type to the second locomotive approach type. The control logic 1000 then proceeds to step 1028.

At step 1026, in an embodiment, the control logic 1000 can downgrade the at least one virtual approach signal indicator from the second locomotive approach type to the first locomotive approach type. The control logic 1000 then proceeds to step 1028.

At step 1028, in an embodiment, the control logic 1000 can locate the virtual approach signal indicator based on geolocation data. For example, the location position of the virtual approach signal indicator can correspond to GPS data, GIS data, latitude-longitude data, milepost data, or any other type of geolocation data relevant to the virtual approach signals.

The present disclosure achieves at least the following advantages:

1. Upgrading a virtual approach signal along a segment of track in response to a physical status indicator of an electronic circuit monitoring the track ahead of a locomotive.
2. Segmenting physical blocks of railway using virtual approach signals allowing for enhanced railway utilization including increased locomotive capacity and velocity.
3. Providing virtual approach signals along a segment of track between physical signaling components for modular signal updating.
4. Increasing a capacity of locomotives allowed along the segment of track in addition to a velocity with which the locomotives can travel.
5. Providing a system agnostic to current operational protocols allowing any locomotive to segment a physical block of railway using virtual approach signals.
6. Enhancing safety of operators, crew, and passengers by providing updated signaling according to current statuses of the segment of track.
7. Reducing costs to a railway organization by optimizing use of the segment of track and minimizing time spent idle for the locomotive.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). For example, the terms "processor" and "controller" can be a class of structures, rather than one specific structure, and may be defined with functional terms, but that does not make it means-plus-function. Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A method for operating a virtual approach signal, includes:

determining a location of a train along a segment of track;

generating virtual approach signal indications based on the location of the train;

monitoring the segment of track for a railway event via an electronic circuit;

displaying an approach virtual signal indication on a positive train control (PTC) locomotive onboard display when a signal location is a first signal indicator and the electronic circuit is energized;

displaying a clear virtual signal indication on the PTC locomotive onboard display when the signal location is a second signal indicator and the electronic circuit is energized;

displaying a restricting virtual signal indication on the PTC locomotive onboard display when the signal location is the first signal indicator or the second signal indicator and when the electronic circuit is not energized; and allowing an update to the virtual approach signal indications located in the segment of track using the electronic circuit along with an upgrade to the signal location.

2. The method of claim 1, wherein the electronic circuit includes an audio frequency circuit.

3. The method of claim 1, wherein the first signal indicator is red or flashing red.

4. The method of claim 1, wherein the second signal indicator is yellow, flashing yellow, or green.

5. The method of claim 1, further comprising:

receiving an updated PTC advancement signal corresponding to the railway event; and updating the virtual approach signal indications in response to receiving the updated PTC advancement signal.

6. The method of claim 5, further comprising upgrading, in response to the updated PTC advancement signal, the virtual approach signal indications from the restricting virtual signal indication to the approach virtual signal indication or the clear virtual signal indication.

7. The method of claim 5, further comprising downgrading, in response to the updated PTC advancement signal, the virtual approach signal indications from the approach virtual signal indication or the clear virtual signal indication to the restricting virtual signal indication.

8. The method of claim 1, wherein the at least one virtual approach signal indicator corresponds to a mapping file.

9. The method of claim 1, wherein the railway event includes a broken rail, an occupied track, an unoccupied track, or a hand-throw switch.

10. The method of claim 1, further comprising locating the virtual approach signal between the physical signaling components based on geolocation data.

11. A wayside system for operating a virtual approach signal, comprising:

a positive train control (PTC) onboard computer; and a processor configured to perform the steps of:

determining a location of a train along a segment of track;

generating virtual approach signal indications based on the location of the train;

monitoring the segment of track for a railway event via an electronic circuit;

displaying an approach virtual signal indication on a positive train control (PTC) locomotive onboard display when a signal location is a first signal indicator and the electronic circuit is energized;

displaying a clear virtual signal indication on the PTC locomotive onboard display when the signal location is a second signal indicator and the electronic circuit is energized;

displaying a restricting virtual signal indication on the PTC locomotive onboard display when the signal location is the first signal indicator or the second signal indicator and if the electronic circuit is not energized; and allowing an update to the virtual approach signal indications located in the segment of track using the electronic circuit along with an upgrade to the signal location.

12. The system of claim 11, wherein the electronic circuit includes an audio frequency circuit.

13. The system of claim 11, wherein the first signal indicator is red or flashing red.

14. The system of claim 11, wherein the second signal indicator is yellow, flashing yellow, or green.

15. The system of claim 11, wherein the processor is further configured to perform the steps of:

receiving an updated PTC advancement signal corresponding to the railway event; and updating the virtual approach signal indications in response to receiving the updated PTC advancement signal.

16. The system of claim 15, wherein the processor is further configured to perform the step of upgrading, in response to the updated PTC advancement signal, the virtual approach signal indications from the restricting virtual signal indication to the approach virtual signal indication or the clear virtual signal indication.

17. The system of claim 15, wherein the processor is further configured to perform the step of downgrading, in response to the updated PTC advancement signal, the virtual approach signal indications from the approach virtual signal indication or the clear virtual signal indication to the restricting virtual signal indication.

18. The system of claim 11, wherein the at least one virtual approach signal indicator corresponds to a mapping file.

19. The system of claim 11, wherein the railway event includes a broken rail, an occupied track, an unoccupied track, or a hand-throw switch.

20. The system of claim 11, further configured to locate the virtual approach signal between the physical signaling components based on geolocation data.

21. A computer-implemented method for operating a virtual approach signal, comprising:

determining a location of a train along a segment of track;

generating virtual approach signal indications based on the location of the train;

monitoring the segment of track for a railway event via an electronic circuit;

displaying an approach virtual signal indication on a positive train control (PTC) locomotive onboard display when a signal location is a first signal indicator and the electronic circuit is energized;

displaying a clear virtual signal indication on the PTC locomotive onboard display when the signal location is a second signal indicator and the electronic circuit is energized;

displaying a restricting virtual signal indication on the PTC locomotive onboard display when the signal location is the first signal indicator or the second signal indicator and if the electronic circuit is not energized; and allowing an update to the virtual approach signal indications located in the segment of track using the electronic circuit along with an upgrade to the signal location.

22. The computer-implemented method of claim 21, wherein the electronic circuit includes an audio frequency circuit.

23. The computer-implemented method of claim 21, wherein the first signal indicator is red or flashing red.

24. The computer-implemented method of claim 21, wherein the second signal indicator is yellow, flashing yellow, or green.

25. The computer-implemented method of claim 21, further comprising:

receiving an updated PTC advancement signal corresponding to the railway event; and updating the virtual approach signal indications in response to receiving the updated PTC advancement signal.

26. The computer-implemented method of claim 25, further comprising upgrading, in response to the updated PTC advancement signal, the virtual approach signal indications from the restricting virtual signal indication to the approach virtual signal indication or the clear virtual signal indication.

27. The computer-implemented method of claim 25, further comprising downgrading, in response to the updated PTC advancement signal, the virtual approach signal indications from the approach virtual signal indication or the clear virtual signal indication to the restricting virtual signal indication.

28. The computer-implemented method of claim 21, wherein the at least one virtual approach signal indicator corresponds to a mapping file.

29. The computer-implemented method of claim 21, wherein the railway event includes a broken rail, an occupied track, an unoccupied track, or a hand-throw switch.

30. The computer-implemented method of claim 21, further comprising locating the virtual approach signal between the physical signaling components based on geolocation data.

* * * * *